US006546995B1

(12) United States Patent
Wagstaff

(10) Patent No.: US 6,546,995 B1
(45) Date of Patent: Apr. 15, 2003

(54) CASTING OF MOLTEN METAL IN AN OPEN ENDED MOLD CAVITY

(75) Inventor: Robert Bruce Wagstaff, Veradale, WA (US)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/693,494

(22) Filed: Oct. 20, 2000

Related U.S. Application Data

(63) Continuation of application No. 08/954,784, filed on Oct. 21, 1997, now Pat. No. 6,158,498.

(51) Int. Cl.[7] ..... B22D 11/124

(52) U.S. Cl. ..... 164/444; 164/268; 164/435; 164/414

(58) Field of Search ..... 164/444, 487, 164/268, 435, 414, 455

(56) References Cited

U.S. PATENT DOCUMENTS 5,678,623 A * 10/1997 Steen et al. ..... 164/268
5,947,184 A * 9/1999 Steen et al. ..... 164/435

FOREIGN PATENT DOCUMENTS

DE 197045 * 11/1970

* cited by examiner

*Primary Examiner*—Tom Dunn
*Assistant Examiner*—I.-H. Lin
(74) *Attorney, Agent, or Firm*—Cooper & Dunham LLP

(57) ABSTRACT

When a body of startup material has been interposed in the cavity between the starter block and a first cross sectional plane of the cavity transverse the axis thereof, the starter block has commenced reciprocating along the axis, and the body of startup material has commenced reciprocating in tandem with it, through a series of second cross sectional planes, layers of molten metal are successively superimposed on the body of startup material adjacent the first cross sectional plane of the cavity, and the layers promptly distend relatively peripherally outwardly from the axis under the inherent splaying forces therein. The invention confines the relatively peripheral outward distention of the layers with a casting surface which is peripherally outwardly flared about the axis of the cavity. Initially, at the circumferential outline of the cross sectional area circumscribed by the surface in the first cross sectional plane of the cavity, the casting surface directs each of the layers into the series of second cross sectional planes at relatively peripherally outwardly inclined angles to the axis. Then the surface allows the layer to assume second cross sectional areas whose cross sectional dimensions undergo continual enlargement peripherally outwardly of the axis, so that the thermal contraction forces arising in the layer can counterbalance the splaying forces while the layer freeforms with the other layers into a body of metal at one of the second cross sectional planes of the cavity.

18 Claims, 19 Drawing Sheets

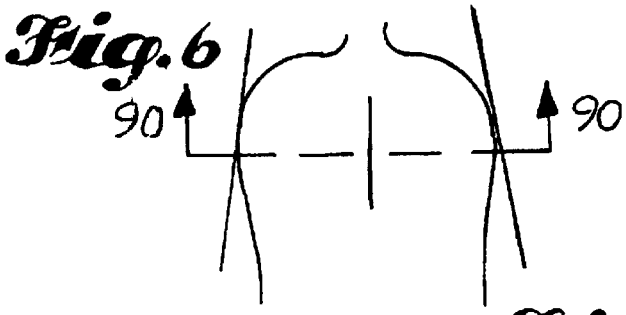
Fig. 6
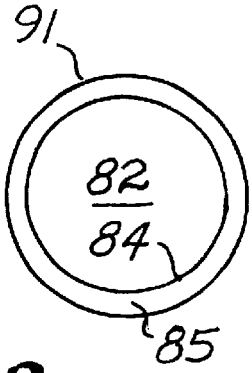
Fig. 1
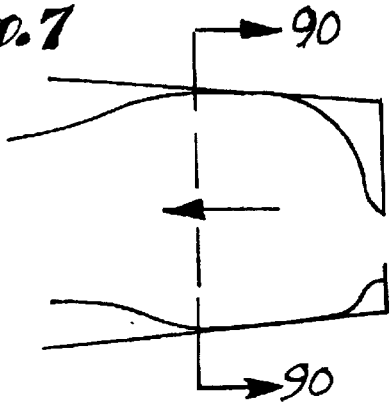
Fig. 7
Fig. 2
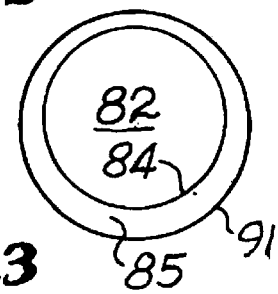
Fig. 3
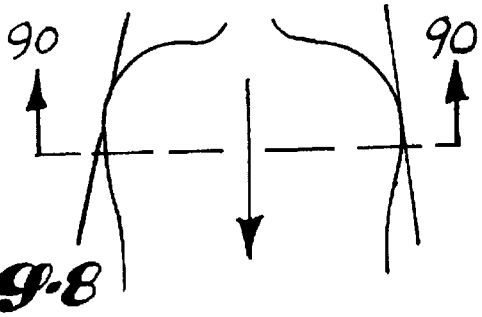
Fig. 8
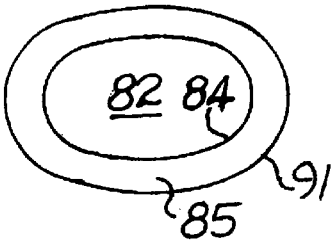
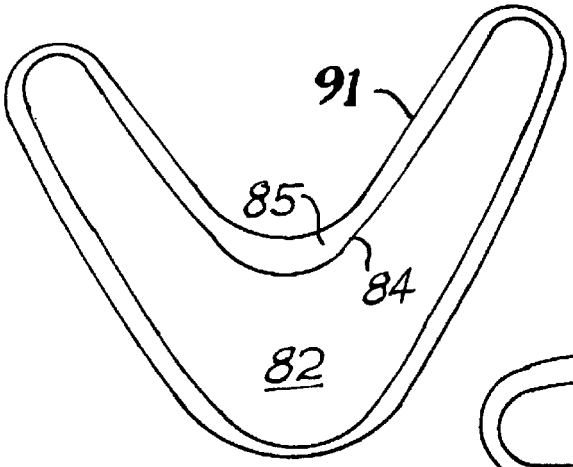
Fig. 4
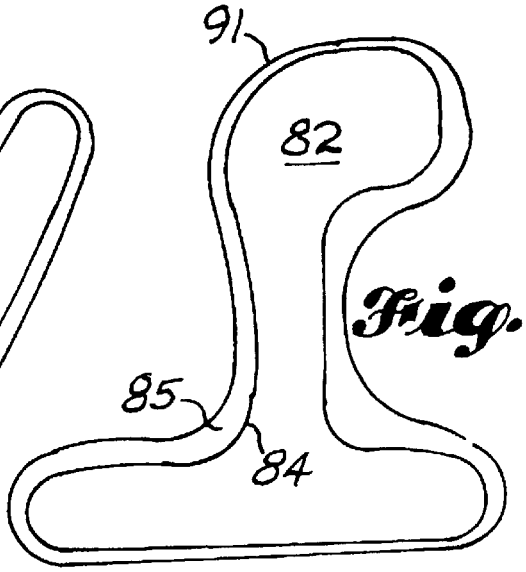
Fig. 5

CASTING OF MOLTEN METAL IN AN OPEN ENDED MOLD CAVITY

This application is a continuation of U.S. patent application Ser. No. 08/954,784, filed on Oct. 21, 1997, now U.S. Pat. No. 6,158,498, issued Dec. 12, 2000.

TECHNICAL FIELD

My invention relates to the casting of molten metal in an open ended mold cavity, and in particular, to the peripheral confinement of the molten metal in the cavity during the casting of it into an end product.

BACKGROUND ART

Present day open ended mold cavities have an entry end, a discharge end opening, an axis extending between the discharge end opening and the entry end of the cavity, and a wall circumposed about the axis of the cavity between the discharge end opening and the entry end thereof to confine the molten metal to the cavity during the passage of the metal through the cavity. When a casting operation is to be carried out, a starter block is telescopically engaged in the discharge end opening of the cavity. The block is reciprocable along the axis of the cavity, but initially, it is stationed in the opening while a body of molten startup material is interposed in the cavity between the starter block and a first cross sectional plane of the cavity extending relatively transverse the axis thereof. Then, while the starter block is reciprocated relatively outwardly from the cavity along the axis thereof, and the body of startup material is reciprocated in tandem with the starter block through a series of second cross sectional planes of the cavity extending relatively transverse the axis thereof, layers of molten metal having lesser cross sectional areas in planes transverse the axis of the cavity than the cross sectional area defined by the wall of the cavity in the first cross sectional plane thereof, are successively superimposed on the body of startup material adjacent the first cross sectional plane of the cavity. Because of their lesser cross sectional areas, each of the respective layers has inherent splaying forces therein acting to distend the layer relatively peripherally outwardly from the axis of the cavity adjacent the first cross sectional plane thereof. It so distends until the layer is intercepted by the wall of the cavity where, due to the fact that the wall is at right angles to the first cross sectional plane of the cavity, the layer is forced to undergo a sharp right angular turn into the series of second cross sectional planes of the cavity, and to undertake a course through them parallel to that of the wall, i.e., perpendicular to the plane. Meanwhile, on contact with the wall, the layer begins to experience thermal contraction forces, and in time, the thermal contraction forces effectively counterbalance the splaying forces and a condition of "solidus" occurs in one of the second cross sectional planes. Thereafter, as an integral part of what is now a newly formed body of metal, the layer proceeds to shrink away from the wall as it completes its passage through the cavity in the body of metal.

Between the first cross sectional plane of the cavity, and the one second cross sectional plane thereof wherein "solidus" occurs, the layer is forced into close contact with the wall of the cavity, and this contact produces friction which operates counter to the movement of the layer and tends to tear at the outer peripheral surface of it, even to the extent of tending to separate it from the layers adjoining it. Therefore, practitioners in the art have long attempted to find ways either to lubricate the interface between the respective layers and the wall, or to separate one from the other at the interface therebetween. They have also sought ways to shorten the width of the band of contact between the respective layers and the wall. Their efforts have produced various strategies including that disclosed in U.S. Pat. No. 4,598,763 and that disclosed in U.S. Pat. No. 5,582,230. In U.S. Pat. No. 4,598,763, an oil encompassed sleeve of pressurized gas is interposed between the wall and the layers to separate one from the other. In U.S. Pat. No. 5,582,230, a liquid coolant spray is developed around the body of metal and then driven onto the body in such a way as to shorten the width of the band of contact. Their efforts have also produced a broad variety of lubricants; and while their combined efforts have met with some success in lubricating and/or separating the layers from the wall and vice versa, they have also produced a new and different kind of problem relating to the lubricants themselves. There is a high degree of heat exchanged across the interface between the layers and the wall, and the intense heat may decompose a lubricant. The products of its decomposition often react with the ambient air in the interface to form particles of metal oxide and the like which become "rippers" at the interface that in turn produce so-called "zippers" along the axial dimension of any product produced in this way. The intense heat may even cause a lubricant to combust, creating in turn a hot metal to cold surface condition wherein the frictional forces are then largely unrelieved by any lubricant whatsoever.

DISCLOSURE OF MY INVENTION

My invention departs entirely from the prior art strategies for separating or lubricating the layers from the wall at the interface therebetween, and from the prior art strategies for shortening the band of contact between the two. Instead, my invention eliminates the "confrontation" between the layers and wall that gave rise to the problems requiring these prior art strategies, and in their place, substitutes a whole new strategy for confining the relatively peripherally outward distention of the respective layers in the cavity during the passage of the molten metal therethrough.

According to my invention, I now arrange baffling means about the axis of the cavity in the means for confining the outer periphery of the molten metal to the cavity during the passage of the metal through the cavity, and while confining the relatively peripheral outward distention of the respective layers of molten metal to first and second cross sectional areas of the cavity in the first and second cross sectional planes thereof, respectively, I operate the baffling means to achieve certain effects at the circumferential outlines of the respective areas. Firstly, I operate the baffling means at the circumferential outline of the first cross sectional area so that the baffling effect thereof directs the respective layers into the series of second cross sectional planes of the cavity at relatively peripherally outwardly inclined angles to the axis thereof. And secondly, while the splaying forces in the respective layers exceed the thermal contraction forces inherently arising therein, I operate the baffling means at the circumferential outlines of the second cross sectional areas so that the baffling effect thereof enables the respective second cross sectional areas to assume progressively peripherally outwardly greater cross sectional dimensions in the second cross sectional planes corresponding thereto while the thermal contraction forces counterbalance the splaying forces and enable the respective layers to freeform a body of metal in one of the second cross sectional planes of the cavity. In this way, I no longer confront the layers with a wall or some other peripheral confinement means, but like a parent teaching a child to walk by extending an outstretched arm on which the child can lean while the parent gradually backs away from the child, so too I give the layers the same kind of passive support at the outer peripheries thereof, and "encourage" them to aggregate on their own, and to form a coherent skin of their own choosing, rather than accepting one imposed on them by a surrounding wall or the like. Also, as fast as the thermal contraction forces can take over from the effects of my baffling means, I withdraw the effects so that contact between the layers and any restraining medium is virtually eliminated. This means that I no longer need to lubricate or buffer the interface between the layers and a peripheral confinement means, but it does not preclude my continuing to use a lubricating or buffering medium in the interface. In fact, in many of the presently preferred embodiments of my invention, I interpose a sleeve of pressurized gas between the baffling means and the circumferential outlines of the respective layers in the first and second cross sectional planes of the cavity. I also commonly interpose an annulus of oil between the baffling means and those outlines, and in certain embodiments I interpose an oil encompassed sleeve of pressurized gas between the two, as in U.S. Pat. No. 4,598,763. I commonly also discharge the pressurized gas into the cavity through the baffling means, and I may also discharge the oil into the cavity through the baffling means. Often, I discharge them into the cavity simultaneously.

In many of the presently preferred embodiments of my invention, I also arrange heat extraction means about the axis of the cavity, and I operate the heat extraction means to extract heat from the angularly successive part annular portions of the layers arrayed about the circumferences thereof. In some of these embodiments, I also operate the baffling means to confer the circumferential outlines on the respective first and second cross sectional areas of the layers in the cavity. And in certain of them, I open up a whole new world of possibilities for open ended mold casting by arranging about the axis of the cavity, axis orientation control means for controlling the orientation of the axis to a vertical line, heat extraction control means for controlling the rate at which heat is extracted by the heat extraction means from the respective angularly successive part annular portions of the layers, first circumferential outline control means for controlling the circumferential outline conferred on the first cross sectional area by the baffling means, and second circumferential outline control means for controlling the circumferential outlines conferred on the respective second cross sectional areas by the baffling means, and operating the respective axis orientation control means, heat control means, and first and second circumferential outline control means in conjunction with the baffling means to confer any predetermined circumferential outline I may choose on the cross sectional area assumed by the body of metal in the one second cross sectional plane of the cavity.

At that plane, before major shrinkage occurs, the circumferential outline I confer on the body of metal will be larger than the circumferential outline I had conferred on the first cross sectional area with the baffling means. But I can easily account for that in the design of each mold, and knowing that, I may operate the first circumferential outline control means so as to cause the baffling means to confer a first circumferential outline on the first cross sectional area, and operate the axis orientation control means, the heat control means, and the second circumferential outline control means, in conjunction with the baffling means, to confer on the cross sectional area of the body of metal in the one second cross sectional plane of the cavity, a predetermined circumferential outline which is larger than but corresponds to the first circumferential outline conferred on the first cross sectional area by the baffling means. Or I may operate the axis orientation control means, the heat control means and the second circumferential outline control means, in conjunction with the baffling means, to confer on the cross sectional area of the body of metal in the one second cross sectional plane of the cavity, a predetermined circumferential outline which is larger than and differs from the first circumferential outline conferred on the first cross sectional area by the baffling means. To illustrate, there are times, such as when the first circumferential outline is an asymmetrical noncircular circumferential outline, that it generates a variance between the differentials existing between the respective splaying forces and thermal contraction forces inherent in angularly successive part annular portions of the layers that are mutually opposed to one another across the cavity in second cross sectional planes thereof, and I may operate the axis orientation control means, the heat control means, and the second circumferential outline control means, in conjunction with the baffling means, to neutralize that variance in third cross sectional planes of the cavity extending parallel to the axis thereof between the respective mutually opposing angularly successive part annular portions of the layers. At other times, such as when the first circumferential outline is a circular circumferential outline, the first circumferential outline may be relatively devoid of a variance between the differentials existing between the respective splaying forces and thermal contraction forces inherent in portions that are mutually opposed to one another across the cavity in the second cross sectional planes thereof, and I may operate the respective axis orientation control means, heat control means, and second circumferential outline control means, in conjunction with the baffling means, to create a variance between the aforesaid differentials in third cross sectional planes of the cavity extending parallel to the axis thereof between mutually opposing angularly successive part annular portions of the layers. For example, the first circumferential outline I confer on the first cross sectional area, may be a circular circumferential outline, and I may operate the axis orientation control means, the heat control means, and the second circumferential outline control means, in conjunction with the baffling means, to confer a symmetrical noncircular circumferential outline on the cross sectional area of the body of metal in the one second cross sectional plane of the cavity, such as an oval or oblate circumferential outline.

In one special case, I operate the first circumferential outline control means to cause the baffling means to confer a circular circumferential outline on the first cross sectional area, I operate the axis orientation control means to orient the axis of the cavity at an angle to a vertical line, such as at a horizontal, and I operate the heat control means and the second circumferential outline control means in conjunction with the baffling means, to confer a circumferential outline on the cross sectional area assumed by the body of metal in the one second cross sectional plane of the cavity, which is simply a predetermined circular outline that is larger in diameter than the first circumferential outline.

The cross sectional dimensions of the body of metal are also within the realm of control that I may exercise in practicing my invention. In one special group of embodiments, I arrange first cross sectional area control means about the axis of the cavity for controlling the cross sectional dimensions conferred on the cross sectional area assumed by the body of metal in the one second cross sectional plane of the cavity, and I operate the first cross sectional area control means in conjunction with the baffling means to confer predetermined cross sectional dimensions on the cross sectional area assumed by the body of metal between a first pair of mutually opposing sides of the cavity in the one second cross sectional plane thereof. Furthermore, in certain embodiments of the group, I add circumferential outline control to cross sectional dimensional control, by arranging circumferential outline control means about the axis of the cavity for controlling the circumferential outlines conferred on the respective first and second cross sectional areas by the baffling means and operating the circumferential outline control means in conjunction with the baffling means to confer a predetermined circumferential outline on the cross sectional area assumed by the body of metal between the first pair of sides of the cavity. And in embodiments which might be characterized as providing an adjustable mold, I arrange second cross sectional area control means about the axis of the cavity for controlling the cross sectional dimensions conferred on the cross sectional area assumed by the body of metal in the one second cross sectional plane of the cavity, and I operate the second cross sectional area control means in conjunction with the baffling means to confer predetermined cross sectional dimensions on the cross sectional area assumed by the body of metal between a second pair of mutually opposing sides of the cavity disposed at right angles to the first pair of sides in the one cross sectional plane of the cavity. For example, in certain embodiments for producing ingot, and in particular, so-called "rolling ingot," I operate the second cross sectional area control means to vary the lengthwise dimensions of a generally rectangular cross sectional area assumed by the body of metal, I operate the circumferential outline control means to confer a relatively bulbous circumferential outline on the midsection extending between the relatively longer sides of the rectangular cross sectional area, and I operate the first cross sectional area control means to maintain a predetermined cross sectional dimension between the longer sides of the rectangular cross sectional area when the lengthwise dimensions of the area are varied. That is, I do something which the prior art was incapable of doing with an adjustable mold: I maintain a predetermined cross sectional dimension between the longer sides of the area being cast while varying the lengthwise dimensions of that area in the mold.

I may control the cross sectional dimensions conferred on the cross sectional area assumed by the body of metal in one of several ways. I may shift the baffling means and the first and second cross sectional planes of the cavity in relation to one another along the axis of the cavity, such as by varying the volume of molten metal superimposed on the body of startup material in the respective layers of molten metal, or by rotating the baffling means about an axis of orientation transverse the axis of the cavity. Or in the context of an adjustable mold, I may divide the baffling means into pairs thereof, arrange the respective pairs of baffling means about the axis of the cavity on pairs of mutually opposing sides thereof, and shift the respective pairs of baffling means in relation to one another crosswise the axis of the cavity to control the cross sectional dimensions conferred on the cross sectional area assumed by the body of metal. For example, I may reciprocate one of the pairs of baffling means in relation to one another crosswise the axis of the cavity to shift the pairs thereof in relation to one another.

On occasion, I may even divide the baffling means into a pair thereof, arrange the pair of baffling means about the axis of the cavity in axial succession to one another, and shift the pair of baffling means in relation to one another axially of the cavity to control the cross sectional dimensions conferred on the cross sectional area assumed by the body of metal. In some embodiments of my invention, for example, I invert the pair of baffling means axially of the cavity to shift one in relation to the other. And in certain of them, I confer the same cross sectional dimensions on the cross sectional area assumed by the body of metal with the respective baffling means. That is, I employ the feature simply as a way to replace one baffling means with another, say when one of them is in need of servicing or replacement.

In a group of embodiments which I shall illustrate in the drawings accompanying my Application, I also operate the baffling means to confine the relatively peripheral outward distention of the respective layers to the first and second cross sectional areas thereof. For example, rather than employing electromagnetic baffling means, or sets of air knives, or some other such baffling means, I form a series of annular surfaces about the axis of the cavity on the baffling means, and I orient the respective surfaces to the axis of the cavity so as to confine the relatively peripheral outward distention of the layers to the first and second cross sectional areas of the cavity while generating the aforedescribed baffling effects at the circumferential outlines thereof. In one group of these embodiments, I arrange the respective annular surfaces in axial succession to one another, I stagger the surfaces relatively peripherally outwardly from one another in the respective first and second cross sectional planes of the cavity, and I orient the surfaces along relatively peripherally outwardly inclined angles to the axis of the cavity so that the baffling effects thereof operate as described. To control the circumferential outline conferred on the first cross sectional area by the baffling means, I vary the circumferential outline circumscribed by the annular surface in the first cross sectional plane of the cavity. To control the circumferential outlines conferred on the second cross sectional areas by the baffling means, I vary the circumferential outlines circumscribed by the annular surfaces in the second cross sectional planes of the cavity. And in one subgroup, I vary in relation to one another, the angles at which angularly successive part annular portions of the surfaces are oriented to the axis of the cavity, so as to vary in this way the circumferential outlines circumscribed by the annular surfaces in the second cross sectional planes of the cavity. And where necessary, I also vary in relation to one another, the angles at which angularly successive part annular portions of the surfaces are oriented to the axis of the cavity on mutually opposing sides of the cavity, to neutralize a variance between the differentials existing between the respective splaying forces and thermal contraction forces in the angularly successive part annular portions of the layers which are disposed opposite the respective part annular portions of the surfaces on the mutually opposing sides of the cavity. Or to create a different outline from that of the first cross sectional area, I vary in relation to one another, the angles at which angularly successive part annular portions of the surfaces are oriented to the axis of the cavity on mutually opposing sides of the cavity, to create a variance between the differentials existing between the respective splaying forces and thermal contraction forces in the angularly successive port annular portions of the layers which are disposed opposite the respective part annular portions of the surfaces on the mutually opposing sides of the cavity.

Sometimes, I even interconnect the annular surfaces with one another axially of the cavity to form an annular skirt. In fact, I may even form the skirt on the peripheral confinement means. And where I circumpose an annular wall about the axis of the cavity as the peripheral confinement means, I often form the skirt about the inner periphery of the wall between the first cross sectional plane of the cavity and the discharge end opening thereof.

Where I form a portion of the wall with a graphite casting ring, I usually form the skirt about the inner periphery of the ring.

I may give the skirt a rectilinear flare about the inner periphery thereof in any of the foregoing embodiments, or I may give it a curvilinear flare about the inner periphery thereof.

For heat extraction, I commonly discharge liquid coolant onto the body of metal at the other side of the one second cross sectional plane of the cavity from the first cross sectional plane thereof, and I control the volume of liquid coolant discharged onto the respective angularly successive part annular portions of the body of metal to control the rate at which heat is extracted from the respective part annular portions of the body of metal in third cross sectional planes of the cavity extending parallel to the axis thereof. Moreover, I commonly also vary the volume of liquid coolant discharged onto the respective part annular portions of the body of metal disposed at mutually opposing sides of the cavity, to balance the thermal stresses arising between the respective mutually opposing part annular portions in third cross sectional planes of the cavity extending therebetween. Preferably, I also discharge the liquid coolant onto the body of metal between planes transverse the axis of the cavity and coinciding with the bottom and rim of the trough-shaped model formed by the successively convergent isotherms of the body of metal.

I may discharge the liquid coolant onto the body of metal from an annulus formed about the axis of the cavity between the one second cross sectional plane of the cavity and the discharge end opening thereof, or I may discharge the liquid coolant onto the body of metal from an annulus formed about the axis of the cavity on the other side of the discharge end opening of the cavity from the one second cross sectional plane thereof. Preferably, I discharge the liquid coolant from a series of holes arranged about the axis of the cavity and divided into rows of holes in which the respective holes thereof are staggered in relation to one another from row to row, as in U.S. Pat. No. 5,582,230.

In many of the presently preferred embodiments of my invention, I actually arrange the series of holes in the cavity at the inner periphery thereof; but in others, I arrange the series of holes relatively outside of the cavity adjacent the discharge end opening thereof.

At times, I also operate the baffling means to generate a reentrant baffling effect in cross sectional planes of the cavity extending transverse the axis thereof between the one second cross sectional plane of the cavity and the discharge end opening thereof, to induce "rebleed" to reenter the body of metal.

At times, I also superimpose sufficient layers of the molten metal on the body of startup material to elongate the body of metal axially of the cavity. When I do so, I may also subdivide the elongated body of metal into successive longitudinal sections thereof, and I may in addition, post-treat the respective longitudinal sections, such as by post-forging them.

BRIEF DESCRIPTION OF THE DRAWINGS

These features will be better understood by reference to the accompanying drawings wherein I have illustrated several presently preferred embodiments of my invention wherein, either in a continuous or semicontinuous casting operation, I deposit molten metal in the cavity as the body of startup material and superimpose the successive layers on the body of molten startup material to form an elongated body of metal extending relatively outwardly of the cavity axially thereof.

In the drawings:

FIGS. 1–5 illustrate several cross sectional areas and circumferential outlines that I may confer on a body of metal at the cross sectional plane in which "solidus" occurs; and in addition, they also show the "first" cross sectional area and the "penumbra" of second cross sectional area that is needed between the circumferential outline of the first cross sectional area and the plane of "solidus" if my process and apparatus are to be fully successful in conferring the respective areas and outlines on the body of metal;

FIGS. 6–8 are schematic representations of a mold I may employ in casting each of the examples in FIGS. 1–3, and they also show schematically the plane in which the examples of FIGS. 1–3 are taken;

BEST MODE FOR CARRYING OUT THE INVENTION

Refer initially to FIGS. 1–8, and make a cursory examination of them. I shall make further reference to them later, and to the numerals in them, but initially note the broad variety of shapes that I can cast by the process and apparatus of my invention. As indicated earlier, I can cast any shape I wish. And I can cast it horizontally, vertically, or even at an incline other than horizontal. FIGS. 1–5 are merely representative. But they include casting a cylindrical shape in a vertically oriented mold, as in FIGS. 1 and 6, casting a cylindrical shape in a horizontal mold, as in FIGS. 2 and 7, casting an oblong or other symmetrical noncircular shape, as in FIGS. 3 and 8, casting an axisymmetric noncircular shape such as the V-shape seen in FIG. 4, and casting a wholly asymmetrical noncircular shape such as that seen in FIG. 5.

The ultimate shape before contraction thereafter, is that seen at 91 in FIGS. 1–5. Because each body of metal undergoes contraction below or to the left of the plane 90—90 seen in FIGS. 6, 7 and 8, the final shape of it is slightly smaller in cross sectional area and circumferential outline than those seen in FIGS. 1–5. But to make it possible to illustrate my invention meaningfully, I have chosen to represent the areas and outlines taken on by the bodies when the splaying forces in them have been counterbalanced by the thermal contraction forces in them, i.e., when the point of "solidus" has been reached in each. This point occurs in the plane 90 of FIG. 18, and therefore, is represented as the plane 90—90 in each of FIGS. 6–8. The remaining numerals and the features to which they allude, will have more meaning when my description has continued further.

Figure 17:
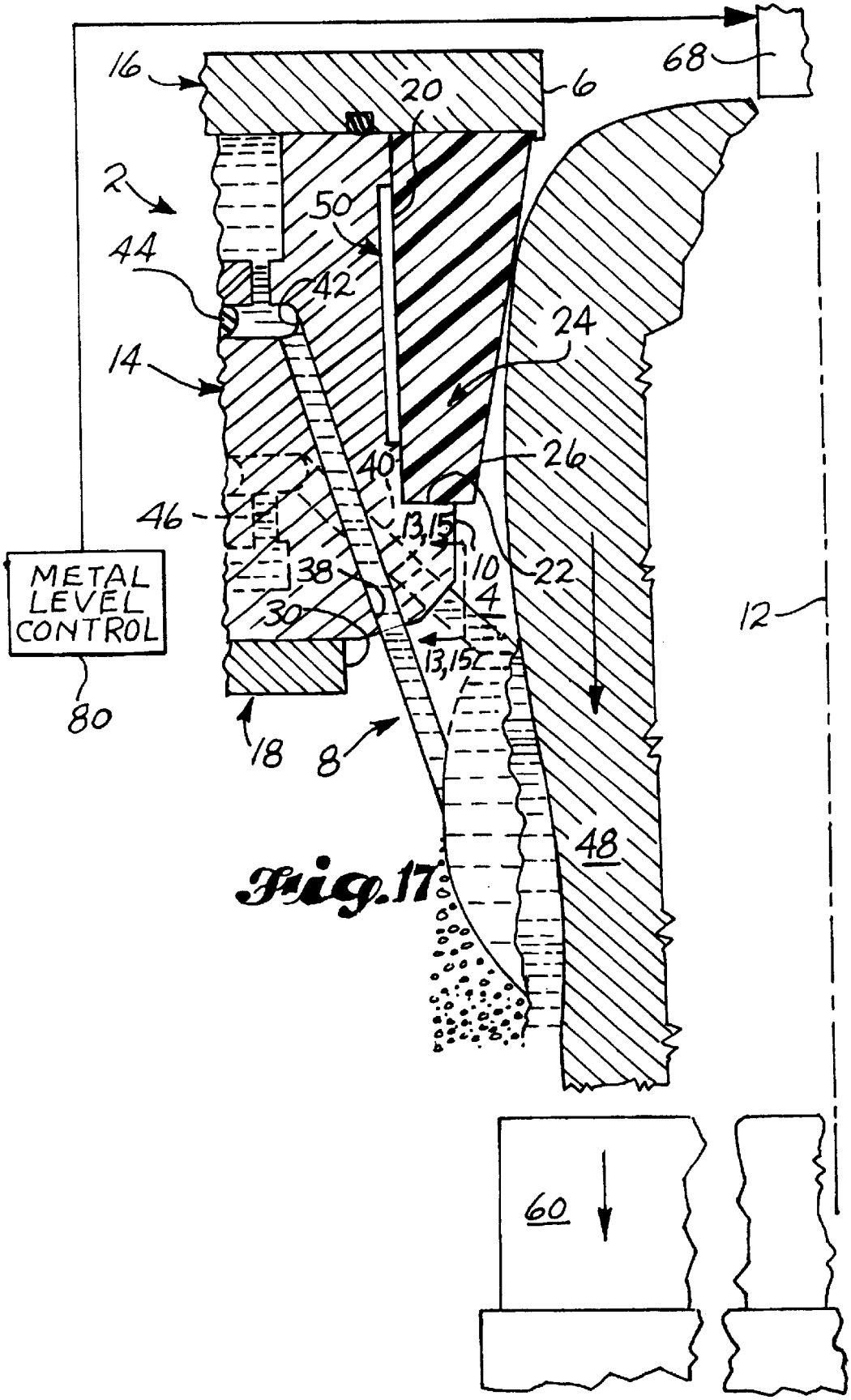
FIG. 17 is an axial cross section of either of the molds seen in FIGS. 9 and 10 and at the time when a casting operation is being conducted in the mold.
Figure 18:
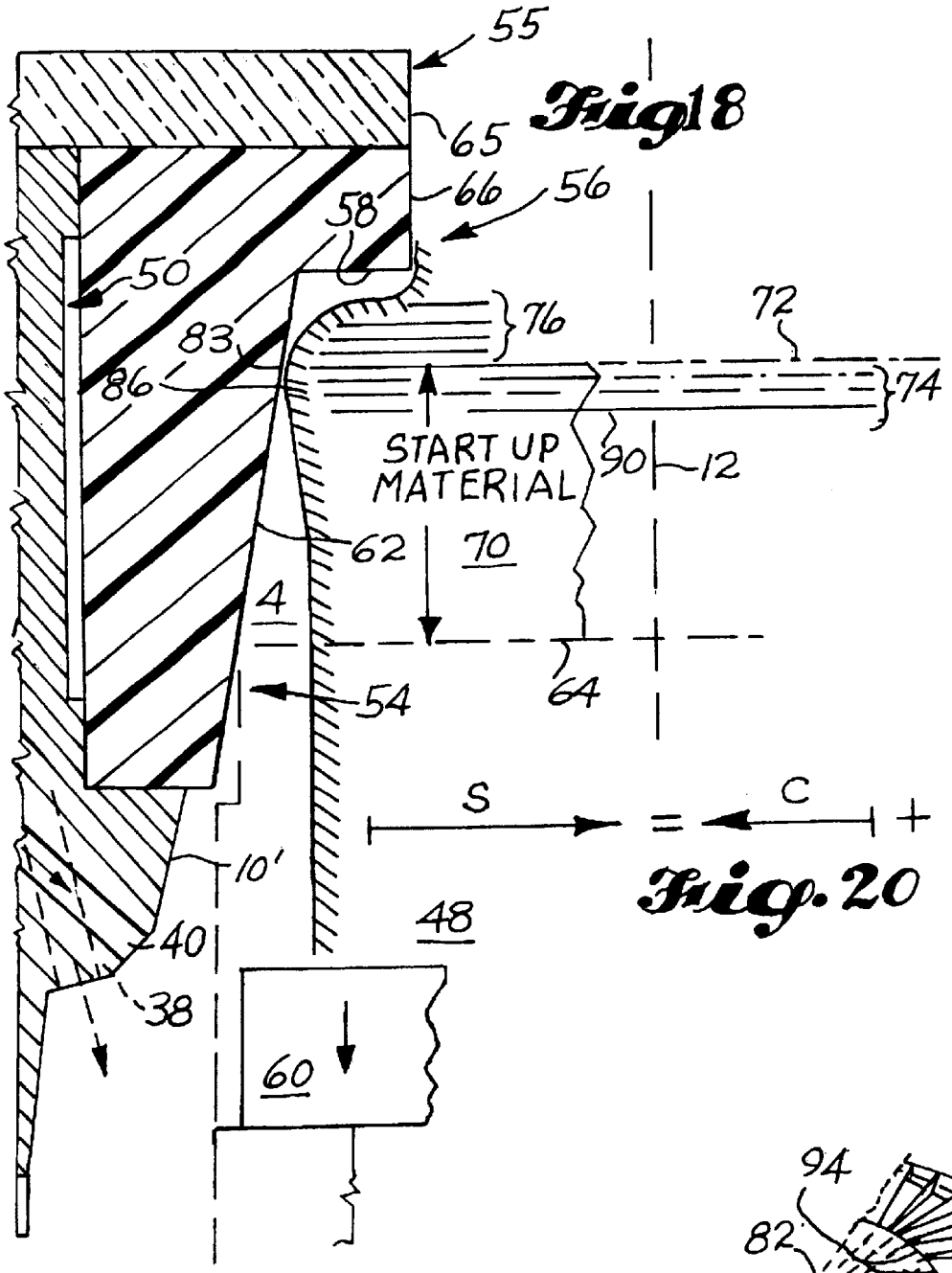
FIG. 18 is a hot topped version of the molds seen in FIGS. 9–15 and 17 at the time of use, and is accompanied by a schematic showing of certain principles employed in all of my molds.

Referring now to FIGS. 9–20, I produce each of the shapes in a mold 2 having an open ended cavity 4 therein, an opening 6 at the entry end of the cavity, and a series of liquid coolant discharge holes 8 circumposed about the discharge end opening 10 of the cavity. The axis 12 of the cavity may be oriented along a vertical line, or along an angle to a vertical line, such as along a horizontal line. The cross section seen in FIGS. 17 and 18 is typical, but typical only, in that as one traverses about the circumference of the cavity, certain features of the mold will vary, not so much in character, but in degree, as shall be explained. Orienting the axis 12 along an angle to a vertical line, will also produce changes, as those familiar with the casting art will understand. But in general terms, the vertical molds seen in FIGS. 9–15 and 17 each comprise an annular body 14 and a pair of annular top and bottom plates 16 and 18, respectively, which are attached to the top and bottom of the mold body, respectively. All three components are made of metal and have a shape in plan view corresponding to that of the body of metal to be cast in the cavity of the mold. In addition, the cavity 4 in the mold body 14 has an annular rabbet 20 thereabout of the same shape as the mold body itself, and the shoulder 22 of the rabbet is recessed well below the entry end opening 6 of the cavity, so that the rabbet can accommodate a graphite casting ring 24 of the same shape as that of the rabbet. The opening in the casting ring has a smaller cross sectional area at the top thereof than the discharge end opening 10 of the cavity, so that at its inner periphery, the ring overhangs the opening 10. The casting ring also has a smaller cross sectional area at the bottom thereof, so as to overhang the opening 10 at that level as well, and between the top and bottom levels of the casting ring, the inner periphery of it has a tapered skirt-like casting surface 26, the taper of which is directed relatively peripherally outwardly from the axis 12 of the cavity in the direction downwardly thereof The taper is also rectilinear in the embodiment shown, but may be curvilinear, as shall be explained more fully hereinafter. Typically, the taper has an inclination of about 1–12 degrees to the axis of the cavity, but in addition to varying in inclination from one embodiment of my invention to another, the taper may also vary in inclination as one traverses about the circumference of the cavity, as shall also be explained. The opening 6 in the top plate or collar 16 has a smaller cross sectional area than those of the mold body 14 and the casting ring 24, so that when overlaid on the mold body and the ring as shown, and secured thereto by cap screws 28 or the like, the plate or collar 16 has a slight lip overhanging the cavity at the inner periphery thereof The opening 30 in the bottom plate 18 has the greatest cross sectional area of all, and in fact, is sufficiently large to allow for the formation of a pair of chamfered surfaces 32 and 34 about the bottom of the mold body, between the discharge end opening 10 of the cavity and the inner periphery of the plate 18.

At its inside, the mold body 14 has a pair of annular chambers 36 extending thereabout, and in order to use the so-called "machined baffle" and "split jet" techniques of U.S. Pat. No. 5,582,230 and U.S. patent application Ser. No. 08/643,767, the series of liquid coolant discharge holes 8 in the bottom of the inner peripheral portion of the mold body actually comprises two series of holes 38 and 40 which are acutely inclined to the axis 12 of the cavity 4 and open into the chamfered surfaces 32 and 34, respectively, of the mold body. At the tops thereof, the holes communicate with a pair of circumferential grooves 42 that are formed about the inner peripheries of the respective chambers 36, but are sealed therefrom by a pair of elastomer rings 44 so that they can form exit manifolds for the chambers. The manifolds are interconnected with the respective chambers 36 to receive coolant from the same through two circumferentially extending series of orifices 46 that also serve as a means for lowering the pressure of the coolant before it is discharged through the respective sets of holes 38 and 40. See U.S. Pat. No. 5,582,230 and U.S. patent application Ser. No. 08/643,767 in this connection, which will also explain more fully the relative inclination of the sets of holes to one another and to the axis of the cavity, so that the more steeply inclined set of holes 38 generates spray as "bounce" from the body of metal 48, and then that spray is driven back onto the body of metal by the discharge from the other set of holes 40, in the manner schematically represented at the surface of the body of metal 48 in FIG. 17.

The mold 2 also has a number of additional components including several elastomer sealing rings, certain of which are shown at the joints between the mold body and the two plates. In addition, means are schematically shown at 50 for discharging oil and gas into the cavity 4 at the surface 26 of the casting ring 24, for the formation of an oil encompassed sleeve of gas (not shown) about the layers of molten metal in the casting operation, and U.S. Pat. No. 4,598,763 can be consulted for the details of the same. Likewise, U.S. Pat. No. 5,318,098 can be consulted for the details of a leak detection system schematically represented at 52.

In FIG. 18, the hot top mold 54 shown therein is substantially the same except that both the opening 52 of the hot top 55 and the upper half of the graphite casting ring 56 are sized to provide more of an overhang 58 than the ring 24 alone provides in FIGS. 9–15 and 17, so that the gas pocket needed for the technique of U.S. Pat. No. 4,598,763 is more pronounced.

When a casting operation is to be conducted with either the mold 2 of FIG. 17 or the mold 54 of FIG. 18, a reciprocable starter block 60 having the shape of the cavity 4 of the mold, is telescoped into the discharge end opening 10 or 10' of the mold until it engages the inclined inner peripheral surface 26 or 62 of the casting ring at a cross sectional plane of the cavity extending transverse the axis thereof and indicated at 64 in FIG. 18. Then, molten metal is supplied either to the opening 65 in the hot top of FIG. 18, or to a trough (not shown) above the cavity in FIG. 17; and the molten metal is delivered to the inside of the respective cavity either through the top opening 66 in the graphite ring of FIG. 18, or through a downspout 68 depending from the trough in the throat formed by the opening 6 in the top plate 16 of FIG. 17.

Initially, the starter block 60 is stationed at a standstill in the discharge end opening 10 or 10' of the cavity, while the molten metal is allowed to accumulate and form a body 70 of startup material on the top of the block. This body of startup material is typically accumulated to a "first" cross sectional plane of the cavity extending transverse the axis of cavity at 72 in FIG. 18. And this accumulation stage is commonly called the "butt-forming" or "start" stage of the casting operation. It is succeeded in turn by a second stage, the so-called "run" stage of the operation, and in this latter stage, the starter block 60 is lowered into a pit (not shown) below the mold, while the addition of molten metal to the cavity is continued above the block. Meanwhile, the body 70 of startup material is reciprocated in tandem with the starter block downwardly through a series of second cross sectional planes 74 of the cavity extending transverse the axis 12 thereof, and as it reciprocates through the series of planes, liquid coolant is discharged onto the body of material from the sets of holes 38 and 40, to direct cool the body of metal now tending to take shape on the block. In addition, a pressurized gas and oil are discharged into the cavity through the surface of the graphite ring, using the means indicated generally at 50 in each of FIGS. 17 and 18.

As can be best seen in FIG. 18, the molten metal discharge forms layers 76 of molten metal which are successively superimposed on the top of the body 70 of startup material, and at a point directly below the top opening of the graphite ring, and adjacent the first cross sectional plane 72 of the cavity. Typically, this point is central of the mold cavity, and in the case of one which is symmetrically or asymmetrically noncircular, is typically coincident with the "thermal shed plane" 78 (FIGS. 10 and 24) of the cavity, a term which will be explained more fully hereinafter. The molten metal may also be discharged into the cavity at two or more points therein, depending again on the cross sectional shape of the cavity, and the molten metal supply procedure followed in the casting operation. But in any case, when the layers 76 are superimposed on the body 70 of startup material, adjacent the first cross sectional plane 72 of the cavity, the respective layers undergo certain hydrodynamics, and particularly when each encounters an object, liquid or solid, which diverts it from its course axially of the cavity, or relatively peripherally outwardly thereof, as shall be explained.

The successive layers actually form a stream of molten metal, and as such, the layers have certain hydrodynamic forces acting on them, and these forces are characterized herein as "splaying forces" "S" (FIG. 20) acting relatively peripherally outwardly from the axis 12 of the cavity adjacent the first cross sectional plane 72 thereof. That is, the forces tend to splay the molten metal material in that direction, and so to speak, "drive" the molten metal into contact with the surface 26 or 62 of the graphite ring. The magnitude of the splaying forces is a function of many factors, including the hydrostatic forces inherent in the molten metal stream at the point at which each layer of molten metal is superimposed on the body of startup material, or on the layers preceding it in the stream. Other factors include the temperature of the molten metal, the composition of it, and the rate at which the molten metal is delivered to the cavity. A control means for controlling the rate is schematically shown at 80 in FIG. 17. See also in this connection, U.S. patent application Ser. No. 08/517,701, filed Aug. 22, 1995 and entitled MOLTEN METAL FEED CONTROL. The splaying forces may not be uniform in all angular directions from the point of delivery, and of course, in the case of a horizontal or other angular mold, they cannot be expected to be equal in all directions. But as shall be explained, my invention takes this fact into account, and I may even capitalize on it in certain embodiments of my invention.

As each layer 76 of molten metal approaches the surface 26 or 62 of the graphite ring, certain additional forces begin to take effect, including the physical forces of viscosity, surface tension, and capillarity. These in turn give the surface of the layer an obliquely inclined wetting angle to the surface 26 or 62 of the ring, as well as to the first cross sectional plane 72 of the cavity. On contacting the surface, certain thermal effects also take effect, and these effects generate in turn ever-enlarging thermal contraction forces "C" (FIG. 20) in the molten metal, that is, forces counter to the splaying forces and tending to shrink the metal relatively peripherally inwardly of the axis, rather than outwardly thereof. But though ever-enlarging, these contraction forces are relatively late in coming, and given a suitable rate of delivery and a mold cavity wherein the splaying forces exceed the thermal contraction forces in the layer when the layer contacts the surface 26 or 62 of the ring in the first cross sectional plane 72 of the cavity, there will be considerable "driving power" remaining in the splaying forces as the layer takes on the first cross sectional area 82 (FIG. 19) circumscribed for it by the annulus 83 (FIG. 18) of the surface in that plane. It is only natural then, that as the layer makes contact with the surface of the ring, it will be readily directed into the series of second cross sectional planes 74 of the cavity, not only by the inclination of the surface 26 or 62 to the axis of the cavity, but also by the natural inclination of the layer to follow the obliquely angled course set for it by the physical forces mentioned earlier. However, were the surface 26 or 62 at right angles to the first cross sectional plane of the cavity, as was the case in the prior art, then the surface would oppose that tendency, and instead of lending itself to the natural inclinations of the layer, would frustrate them, leaving the layer no other choice than to make the right angular turn required of it and to roil itself along the surface as best it can, parallel to the axis, while maintaining close contact with the surface. This contact leads in turn to friction, and the friction in turn has been the bane of every mold designer, causing him or her to seek ways in turn to overcome it, or to separate the layers from the surface so as to minimize the role friction plays between them. Of course, friction suggests the use of lubricants, and lubricants have been employed in great numbers. As indicated earlier, there is intense heat flowing between the layers and the surface, and the lubricants themselves have posed a different kind of problem in that the intense heat tends to decompose a lubricant, and often the products of its decomposition react with the air at the interface between the layers and the surface, and produce metal oxides or the like which in turn become particle-like "rippers" (not shown) at the interface that produce so-called "zippers" along the axial dimension of any product produced in this way. Therefore, while lubricants have reduced the effects of friction, they have in turn produced a different kind of problem for which no solution has been developed as yet.

Returning now to FIGS. 18–20, note that at the circumference 84 (FIG. 19) of the first cross sectional area 82, each layer is not only directed headlong into the series of second cross sectional planes 74 of the cavity, but also allowed to take on second cross sectional areas 85 therein which have progressively peripherally outwardly greater cross sectional dimensions in the second cross sectional planes 74 corresponding thereto. The layer is never free, however, to "bleed" out of control in those planes, but instead, is at all times under the control of the baffling means provided by the annuli 86 at the surface 26 or 62 of the ring in the respective second cross sectional planes 74 of the cavity. The annuli 86 operate to confine the continued relatively peripheral outward distention of the layer, and to define the circumferential outlines 88 of the second cross sectional areas 85 taken on by the layer in the planes 74. But because of their relatively peripherally outwardly inclined angles to the axis 12, and their relatively peripherally outwardly staggered relationship to one another, they do so "retractively," or passively, so that the layer can assume progressively relatively peripherally outwardly greater cross sectional dimensions in the respective second planes corresponding thereto, as indicated. Meanwhile, the thermal contraction forces "C" (FIG. 20) arising in the layer begin to counter the splaying forces remaining in it and ultimately, to counterbalance the splaying forces altogether, so that when they have done so, the retractive baffling effect "R" in the equation of FIG. 20 may, so to speak, drop out of the equation. That is, baffling will no longer be needed. "Solidus" will have occurred and the body of metal 48 will be in effect a body capable of sustaining its own form, although it will continue to undergo a certain degree of shrinkage, transverse the axis of the cavity, and this can be seen in FIG. 18, below the "one" second cross sectional plane 90 of the cavity in which the counterbalancing effect had occurred, that is, in which "solidus" had taken place.

Figure 19:
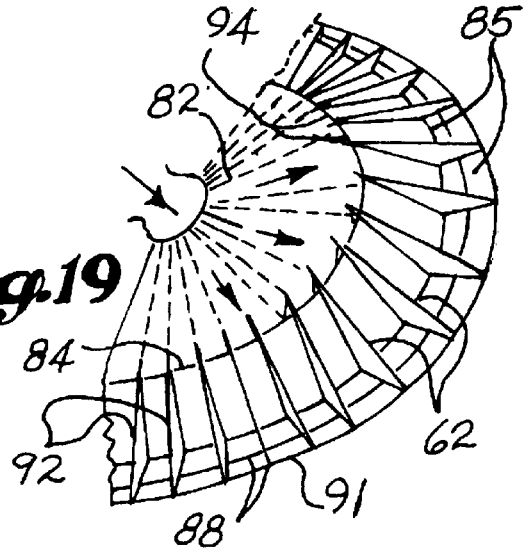
FIG. 19 is a schematic representation of the principles, but using a set of angularly successive diagonals to represent the casting surface of each mold, so that certain areas and outlines can be seen therebelow in the Figure.

Referring once again to FIGS. 1–8, and in conjunction with FIG. 19, it will be seen that in the case of each shape, "solidus" is represented by the outside circumferential outline 91 of the shape, whereas the relatively inside outline 84 is that of the first cross sectional area 82 given each layer by the annulus 83 in the first cross sectional plane 72 of the cavity. And the "penumbra" between each pair of outlines is the progressively larger second cross sectional area 85 taken on by the respective layers before "solidus" occurs at plane 90.

The surface 26 or 62 of each ring has angularly successive part annular portions 92 (between the diagonals of FIG. 19 representing the surface) arrayed about the circumference thereof, and if the circumferential outline of the surface is circular, the angle of its taper is the same throughout the circumference of the surface, the axis 12 of the cavity is oriented along a vertical line, and heat is uniformly extracted from the respective angularly successive part annular portions 94 (FIGS. 10 and 19) of the layers about the circumferences thereof, then the body of metal will likewise assume a circular outline about the cross sectional area thereof in the plane 90. That is, if a vertical billet casting mold is used, the surface 26 or 62 of it is given these characteristics, and the heat extraction means 8 including the "split jet" system of holes, 38, 40, are operated to extract heat from the respective portions 94 of the billet at a uniform rate about the circumference thereof, then in effect, the annulus 83 will confer a circular circumferential outline 84 on the first cross sectional area 82 therewithin, the annuli 86 will confer similar circumferential outlines 88 on the respective second cross sectional areas 85 therewithin, and the body of metal will prove to be cylindrical, since any thermal stresses generated in the body crosswise thereof in third cross sectional planes 95 (FIG. 9 and the diagonals representing the surface 26 or 62 in FIG. 19) of the cavity extending parallel to the axis thereof between portions 94 of the body on mutually opposing sides of the cavity, will tend to balance one another from side to side of the cavity. But when a noncircular circumferential outline is chosen for the body of metal at the plane 90, or the axis of the mold is oriented at an angle to a vertical line, or heat is extracted from the portions 94 at a non-uniform rate, then various controls must be introduced with respect to several of the features of my invention.

Firstly, some way must be provided for balancing the thermal stresses in the third cross sectional planes 95 of the cavity. Secondly, the layers 76 of molten metal must be allowed to transition through the series of second cross sectional planes 74, at cross sectional areas 85 and circumferential outlines 88 which are suited to the cross sectional area and circumferential outline intended for the body of metal in plane 90. This means that a cross sectional area 82 and circumferential outline 84 suited to that end, must be chosen for the first cross sectional plane 72. It also means that if the outline is to be reproduced at plane 90, though the area of the body of metal in that plane will be larger, then some way must be provided to account for variances in the differentials existing between the splaying forces "S" and/or the thermal contraction forces "C" in angularly successive part angular portions 94 of the layers, on mutually opposing sides of the cavity.

I have developed ways with which to control each of these parameters, including ways, if I choose, with which to create a variance among the parameters, so that I can form from commonplace first cross sectional areas and/or circumferential outlines, such as circular ones, shapes which are akin to but unlike those areas or outlines, such as ovals. I have also developed ways for controlling the cross sectional dimensions of the cross sectional area of the body of metal in the plane 90. And I shall now explain each of these control mechanisms.

Figure 9:
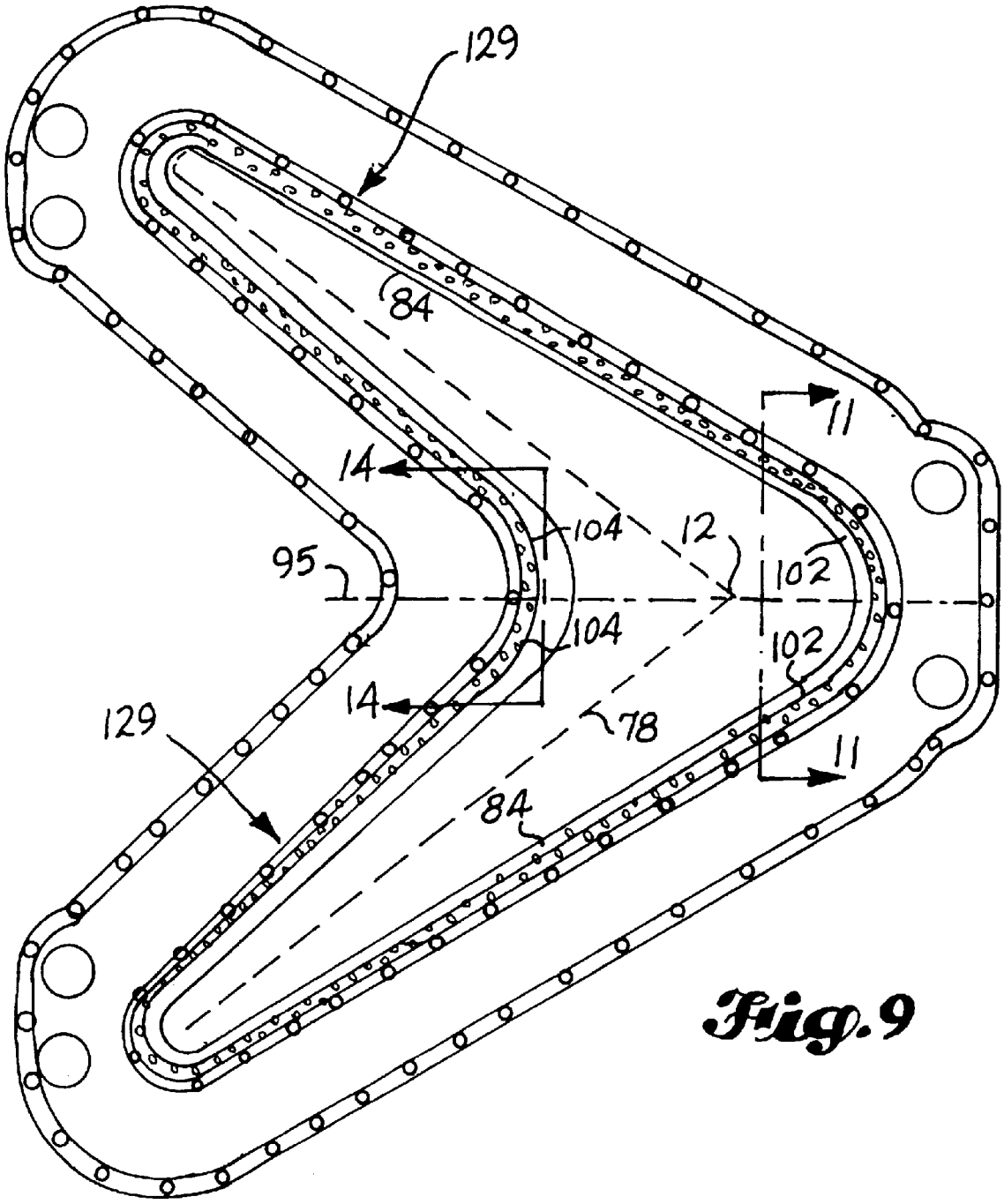
FIG. 9 is a bottom plan view of an open-topped vertical mold for casting a V-shaped body of metal such as that seen in FIG. 4, and showing in addition, the circumferential outline of the first cross sectional area in the cavity of the mold.
Figure 10:
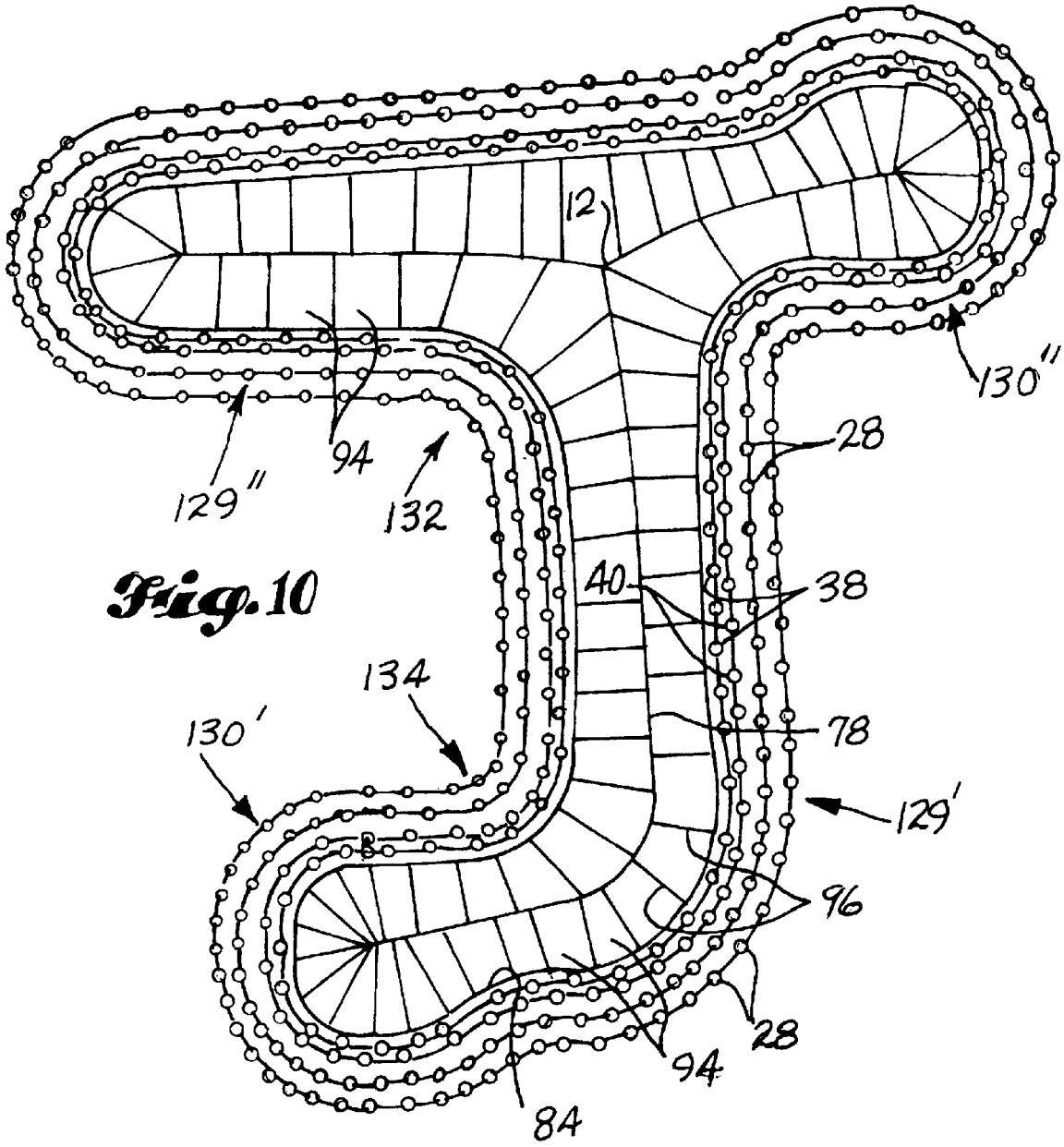
FIG. 10 is a similar view of an open-topped vertical mold for casting a sinuous asymmetrical noncircular body of metal such as the generally L-shaped one seen in FIG. 5, but showing now within the cavity of the mold, the theoretical basis for the scheme I employ in varying the rate at which heat is extracted from the angularly successive part annular portions of the body of metal to balance the thermal stresses arising between mutually opposing portions thereof in cross sectional planes of the cavity extending parallel to the axis thereof.
Figure 11:
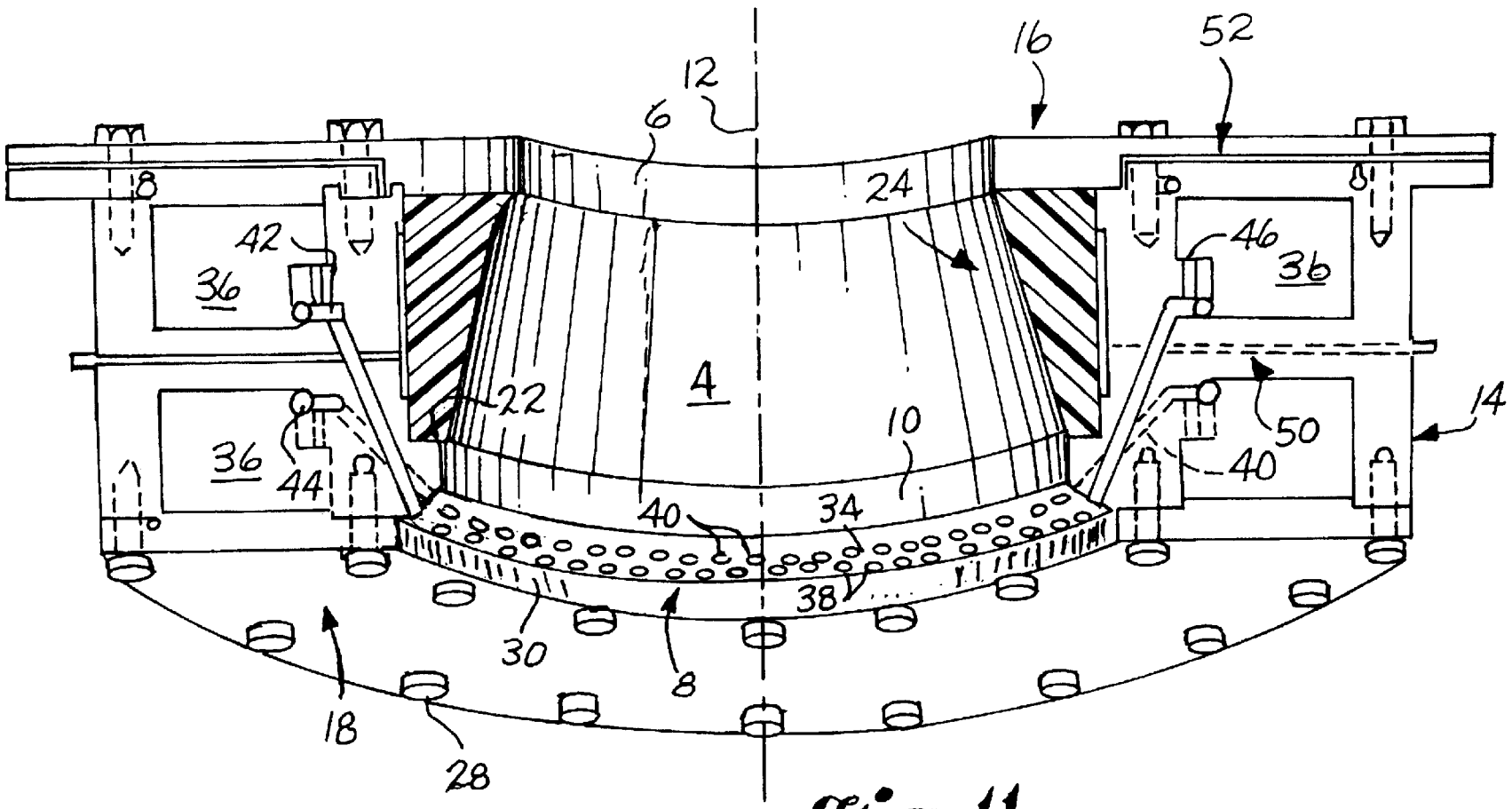
FIG. 11 is an isometric cross section along the line 11—11 of FIG. 9.
Figure 12:
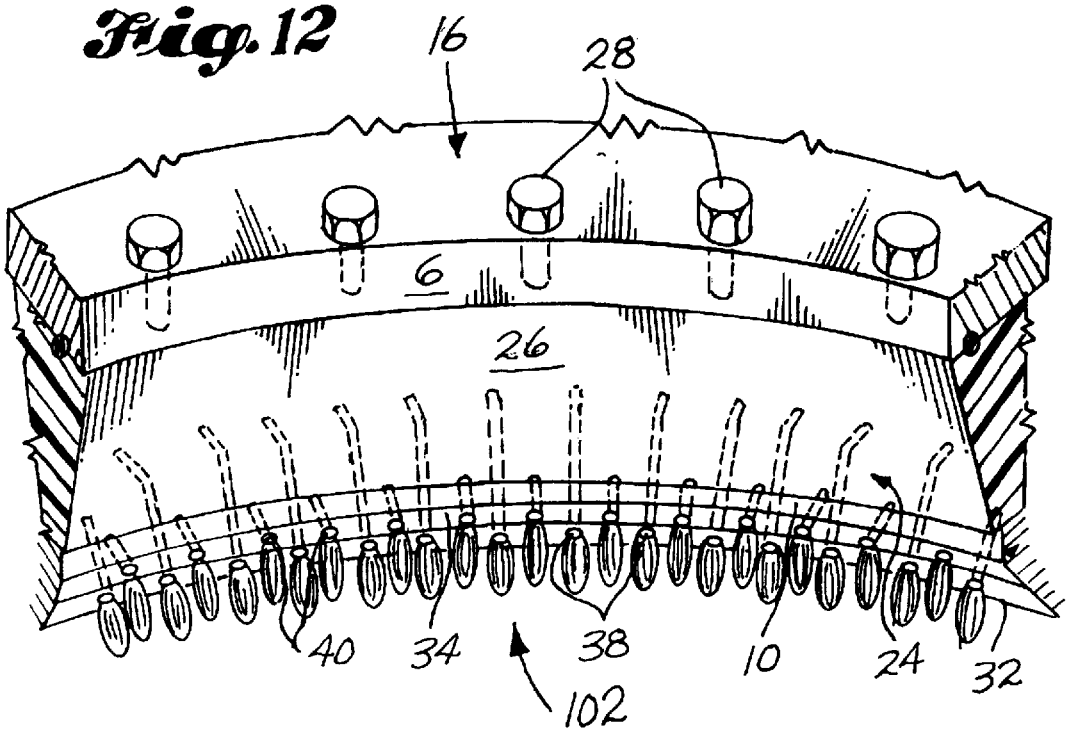
FIG. 12 is a relatively enlarged and more steeply angled part schematic isometric showing the center portion of the isometric cross section seen in FIG. 11.
Figure 14:
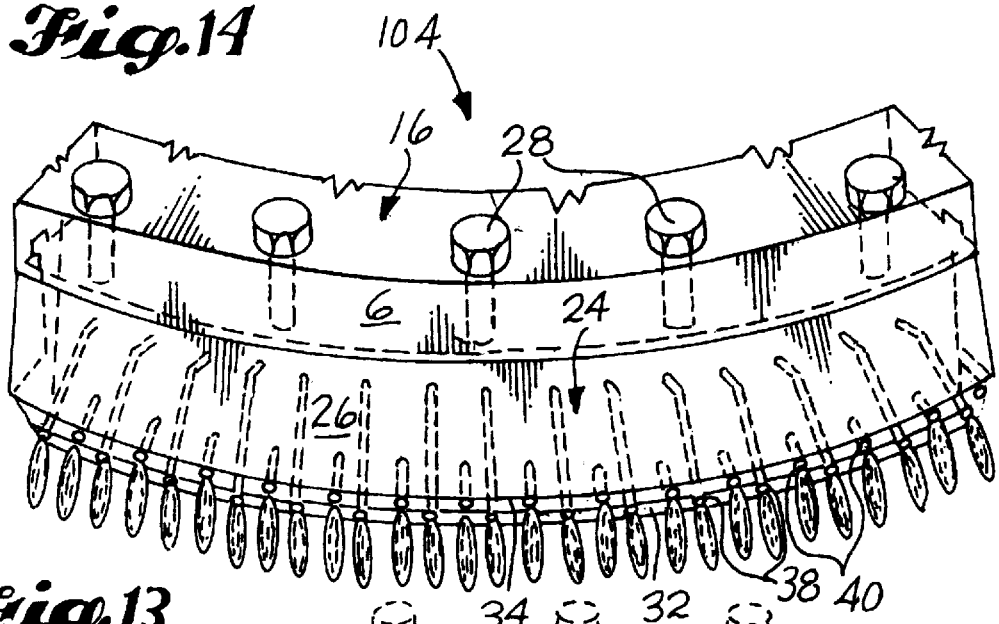
FIG. 14 is an isometric part schematic cross section along the line 14—14 of FIG. 9 and like that of FIG. 12, more enlarged and steeply inclined than the isometric cross section of FIG. 11.
Figure 13:
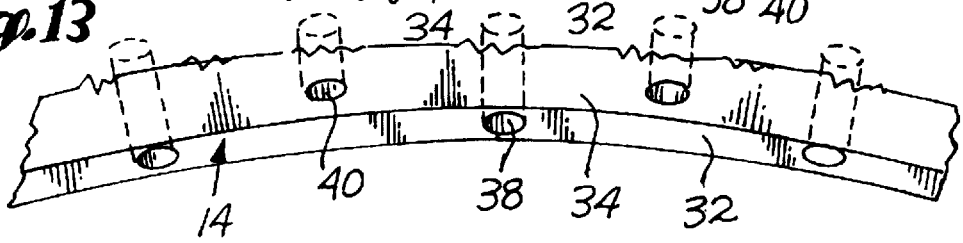
FIG. 13 is a cross section along the line 13, 15 of FIG. 17, showing the two series of coolant discharge holes employed in extracting heat from the angularly successive part annular portions of the body of metal occupying a relatively concave bight in FIGS. 9, 11 and 12, and particularly for comparison with the two series of holes to be shown in this connection in FIG. 15 hereafter.
Figure 15:
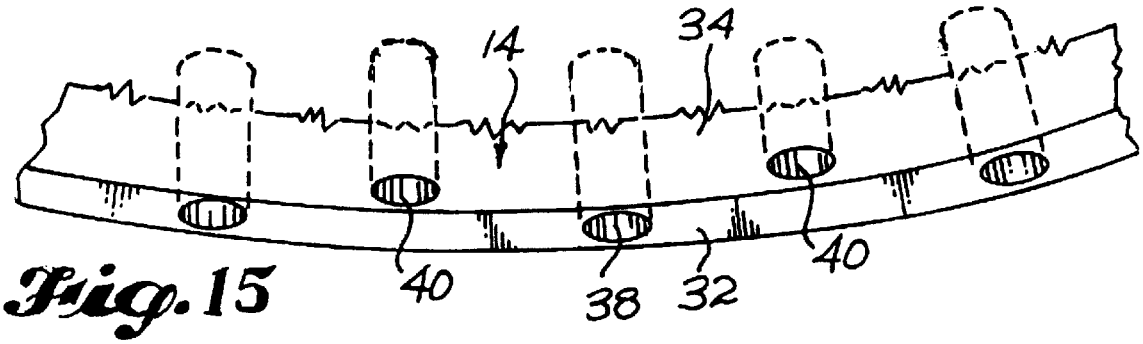
FIG. 15 is another cross section along the line 13, 15-13, 15 of FIG. 17 showing the two series of coolant discharge holes employed for heat extraction in a relatively convex bight in FIG. 14, and in this instance, for comparison with the two series shown at the concave bight of FIG. 13, as mentioned earlier.
Figure 16:
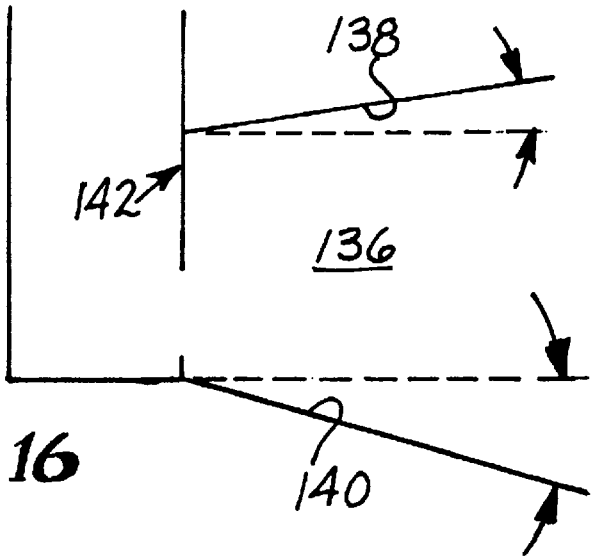
FIG. 16 is a further schematic representation in support of FIGS. 2 and 7.

As for balancing the thermal stresses, reference should be made firstly to FIG. 10 and then to the remainder of FIGS. 9–15 as well. To control the thermal stresses in any noncircular cross section, such as the asymmetrical noncircular cross section seen in FIG. 10, I first plot the respective angularly successive part annular portions 94 of the body of metal, by extending normals 96 into the thermal shed plane 78 from the circumferential outline 84 of the cross section, and at substantially regular intervals thereabout. Then, in fabricating the mold itself, I provide for discharging variable amounts of liquid coolant onto the respective portions 94 so that the rate of heat extraction from portions on mutually opposing sides of the outline is such that the thermal stresses arising from the contraction of the metal, will tend to be balanced from side to side of the body. Or put another way, I discharge coolant about the body of metal in amounts adapted to equalize the thermal contraction forces in the respective mutually opposing portions of the body.

Figure 24:
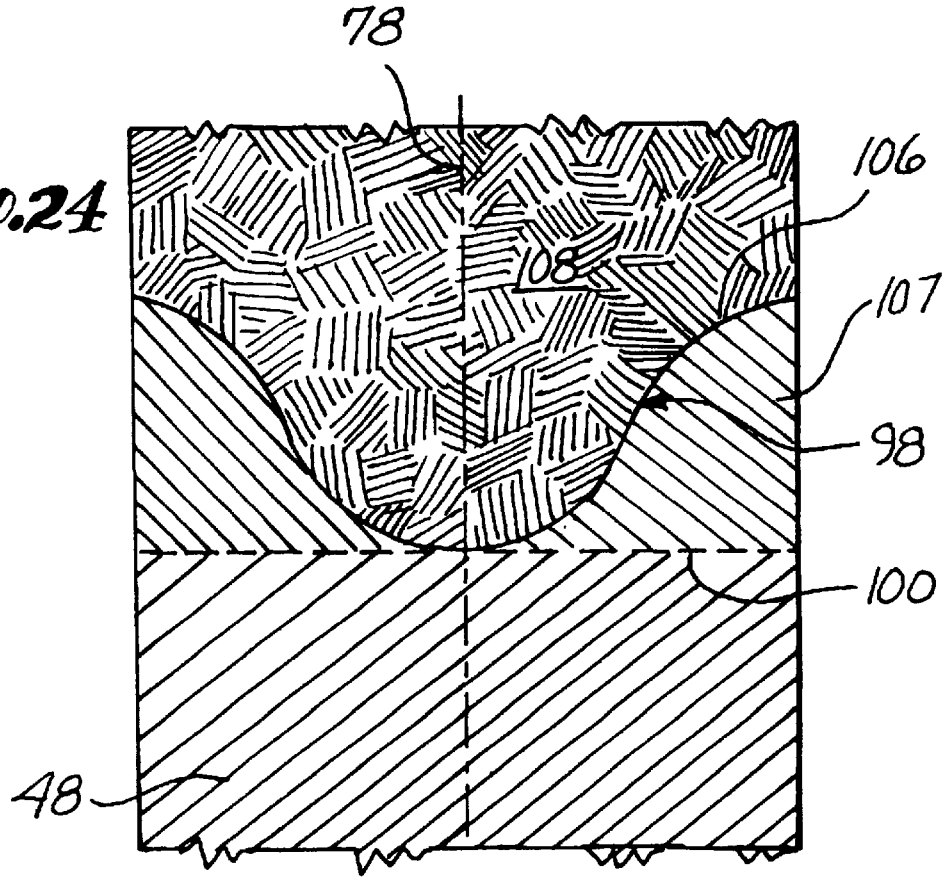
FIG. 24 is a thermal cross section through a typical casting, showing the trough-shaped model of successively convergent isotherms therein and the thermal shed plane thereof.

The "thermal shed plane" (FIG. 24) is that vertical plane coinciding with the line of maximum thermal convergence in the trough-shaped model 98 defined by the successively converging isotherms of any body metal. Put another way, and as seen in FIG. 24, it is the vertical plane coinciding with the cross sectional plane 100 of the cavity at the bottom of the model, and in theory, is the plane to the opposing sides of which heat is discharged from the body of metal to the outline thereof.

To vary the amount of coolant discharged onto the portions 94, I vary the hole sizes of the individual holes 38 and 40 in the respective sets thereof. Compare the hole sizes in FIGS. 13 and 15 for the holes 38, 40 disposed adjacent the mutually opposing convexo/concave bights 102 and 104 of the cavity seen in FIG. 9. At bights such as these, severe stresses can be expected unless such a measure is taken. Other ways can be adopted to control the rate of heat extraction, however, such as by varying the numbers of holes at any one point on the circumference of the cavity, or varying the temperature from point to point, or by some other strategy which will have the same effect.

Preferably, I also discharge the coolant onto the body of metal 48 (FIG. 24) so as to impact the same between the cross sectional plane 100 of the cavity at the bottom of the model 98 and the plane at the rim 106 thereof, and preferably, as close as I can to the latter plane, such as onto the "cap" 107 of partially solidified metal formed about the mush 108 in the trough of the model.

Figure 21:
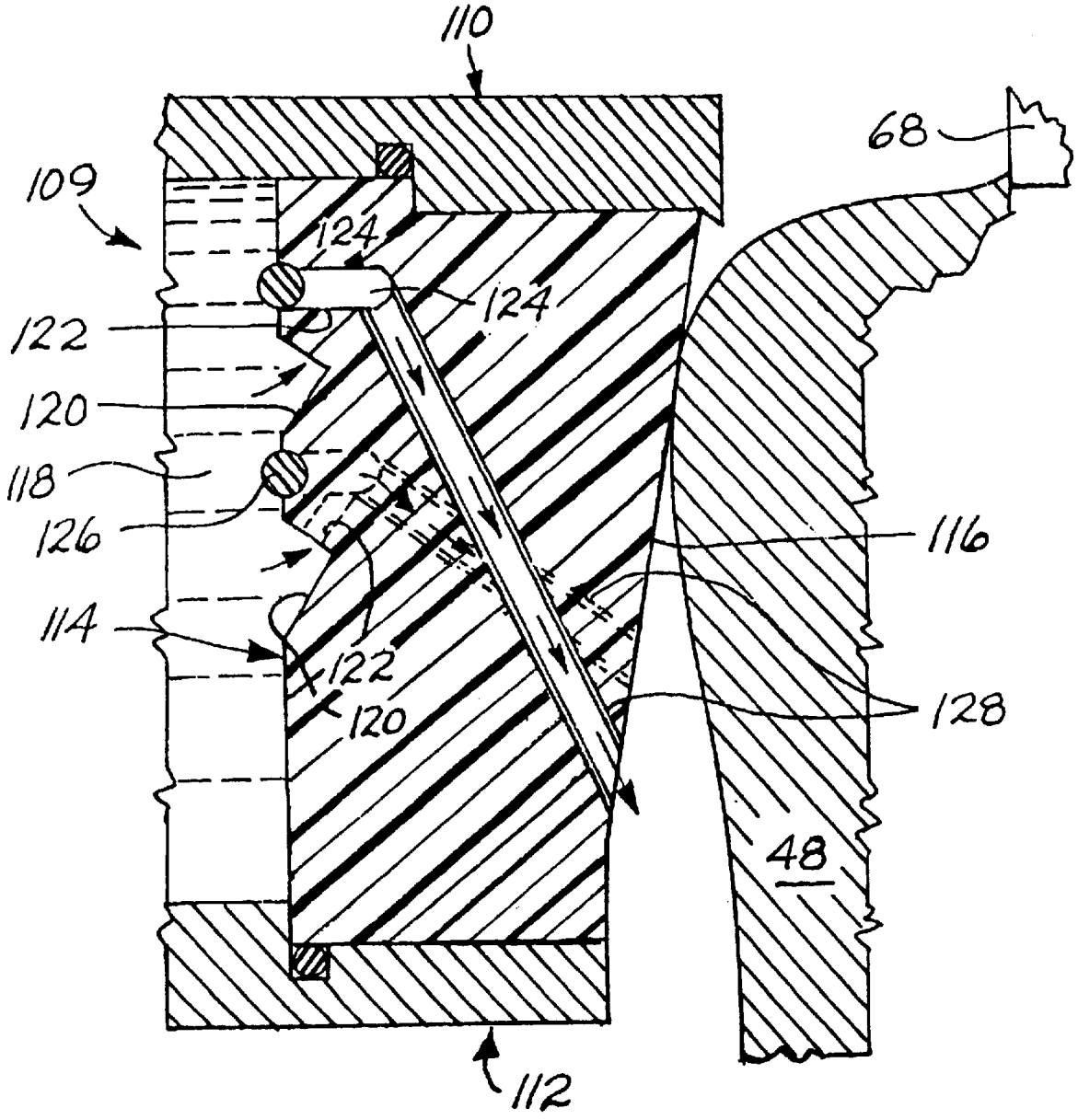
FIG. 21 is a view similar to that of FIGS. 17 and 18, but showing a modified form of mold which provides for the coolant being discharged directly into the cavity of the mold.

Depending on the casting speed, this may even mean discharging the coolant through the graphite ring and into the cavity, as seen through the cross section of FIG. 21. In this instance, the mold 109 comprises a pair of top and bottom plates 110 and 112, respectively, which are cooperatively rabbeted to capture a graphite ring 114 therebetween. The ring 114 is operable not only to form the casting surface 116 of the mold, but also to form the inner periphery of an annular coolant chamber 118 arranged about the outer periphery thereof. The ring has a pair of circumferential grooves 120 about the outer periphery thereof, and the grooves are chamfered at the tops and bottoms thereof to provide suitable annuli for series of orifices 122 discharging into an additional pair of circumferential grooves 124 suitably closed with elastomer sealing rings 126 at the outer peripheries thereof. The grooves 124 discharge in turn into two sets of holes 128 which are arranged about the axis of the cavity to discharge into the same in the manner of U.S. Pat. No. 5,582,230 and U.S. patent application Ser. No. 08/643,767. The holes 128 are commonly varnished or otherwise coated to contain the coolant in its passage therethrough, and once again, sealing rings are employed between the respective plates and the graphite ring to seal the chamber from the cavity.

To derive the area 82, outline 84, and "penumbra" 85 needed to cast a product having a noncircular area and outline 91, 1 use a process which can be best described with reference to FIGS. 9 and 10. Each provides an opportunity to evaluate a noncircular circumferential outline and the curvilinear and/or anglolinear "arms" 129 extending peripherally outwardly form the axis 12 therewithin. The arms 129 themselves also have contours therewithin which are curvilinear and/or anglolinear, and opposing contours therebetween which are convexo/concave. Therefore, if one chooses to traverse any third cross sectional plane 95 of the cavity, he/she will find that the contours on the opposing sides of the cavity are likely to generate a variance between the differentials existing in the mutually opposing angularly successive part annular portions 94 of the layers on those sides. For example, the angularly successive part annular portions of the layers disposed opposite the bights 102 and 104 of FIG. 9 will experience dramatically different splaying forces in the casting of the "V." At the relatively concave bight 102, the molten metal in the portions 94 will tend to experience compression, "pinching" or "bunching up," because under the dynamics of the casting operation, the two arms 129 of the "V" will tend to rotate toward one another, and in effect compress or "crowd" the metal in the bight 102. On the other hand, at the relatively convex bight 104, the rotation of the arms will tend to relax or open up the metal in the portions thereopposite, so that a wide variance will arise between the differentials existing between the splaying forces and the thermal contraction forces in the respective portions. The same is true in FIG. 10, but compounded by the presence of arms 129 which have appendages 130 thereon in turn. After start, the arm 129', for example, tends to rotate in the clockwise direction of FIG. 10, whereas the arm 129" tends to rotate in the counterclockwise direction. Meanwhile, the appendage 130' on the arm 129' and the appendage 130" on the arm 129" tend to also rotate counter directionally. Each has an effect on the hydrodynamics of the metal in the convexo/concave bights 132 or 134 extending therebetween; while on the other hand, there are actually points on the outline of the Figure which experience little consequence from the rotation of the respective arms or appendages, such as at the tips of the respective arms or appendages.

Figure 20:
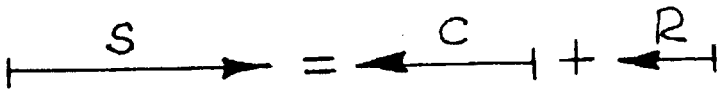
FIG. 20 is an arithmetic representation of certain principles.

To neutralize the various variances, and to account for the contraction that each arm 129 is also experiencing lengthwise thereof, I vary the taper of the respective angularly successive part annular portions 92 (FIG. 19) of the surface 26 or 62 of the casting ring disposed opposite the portions 94 so as to vary the "R" factor in the equation of FIG. 20 to the extent that the splaying forces in the respective portions 94 of the layers have an equal opportunity to spend themselves in the respective angularly successive part annular portions of the second cross sectional areas 85 disposed thereopposite. Note for example, that the concave bight 104 in FIG. 9 has a wide part annular segment of the "penumbra" 85 to account for the higher splaying forces therein, whereas the convex bight 102 thereopposite has a far narrower segment of the "penumbra," because of the relatively lower splaying forces experienced by the portions of the layers thereopposite. The outline of FIG. 10 is put through similar considerations, usually in a multi-stage process that addresses the contraction and/or rotation each arm or appendage will experience in the casting process, and then extrapolates between adjacent effects to choose a taper meeting the needs of the higher effect. If, for example, one of two adjacent effects requires a five degree taper, and another a seven degree taper, then the seven degree taper would be chosen to accommodate both effects. The result is schematically shown in the "penumbras" 85 of FIGS. 4 and 5, and a close examination of them is recommended to understand the process used.

Of course, it is the cross sectional area and outline seen at 91 in each case, that is desired from the process. Therefore, the process is actually conducted in the reverse direction, to derive a "penumbra" first which will in turn dictate the cross sectional outline 84 and cross sectional area 82 needed for the opening in the entry end of the mold.

Using a variable taper as a control mechanism, I am also able to cast cylindrical billet in a horizontal mold from a cavity having a cylindrical circumferential outline about the first cross sectional area thereof. See FIGS. 2 and 7, as well as FIG. 16, and note that to do so, the cavity 136 must have a sizable swale 85 in the bottom thereof, between the outline 84 of the first cross sectional area 82 and the circumferential outline 91 conferred on the body of metal in the plane 90. This is represented schematically in FIG. 16 which shows the size differentiation needed between the angles of the casting surface at the top 138 and bottom 140 of the mold 142 for this effect alone.

Figure 25:
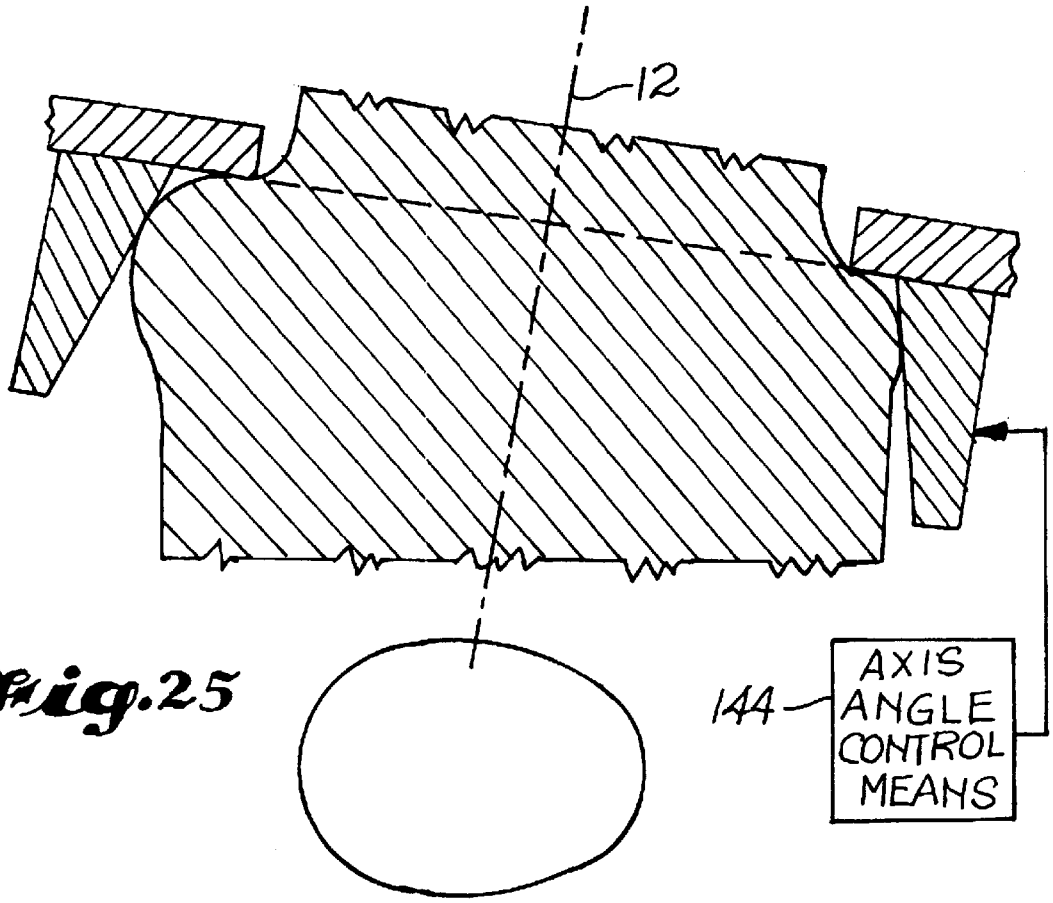
FIG. 25 is a schematic representation of a way to generate an oval or other symmetric noncircular circumferential outline, from a first cross sectional area of circular outline, by tilting the axis of the mold.
Figure 26:
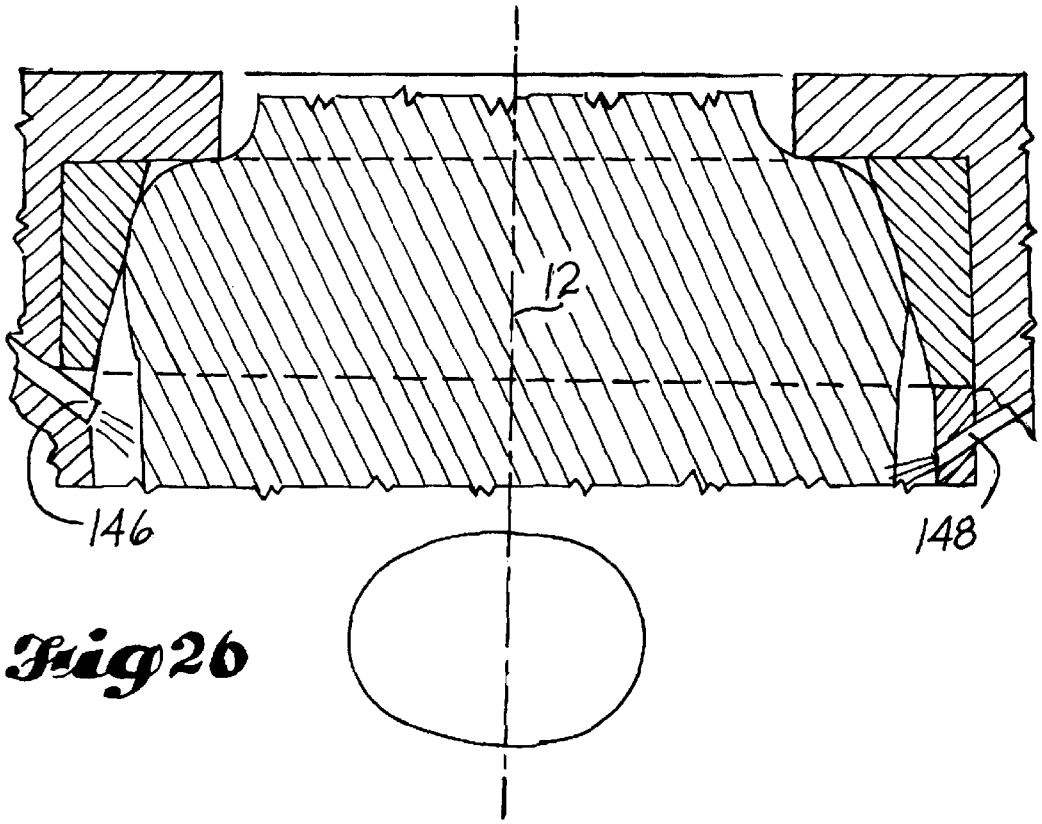
FIG. 26 is a schematic representation of another way of doing so by varying the rate at which heat is extracted from angularly successive part annular portions of the body of metal on opposing sides of the mold.
Figure 27:
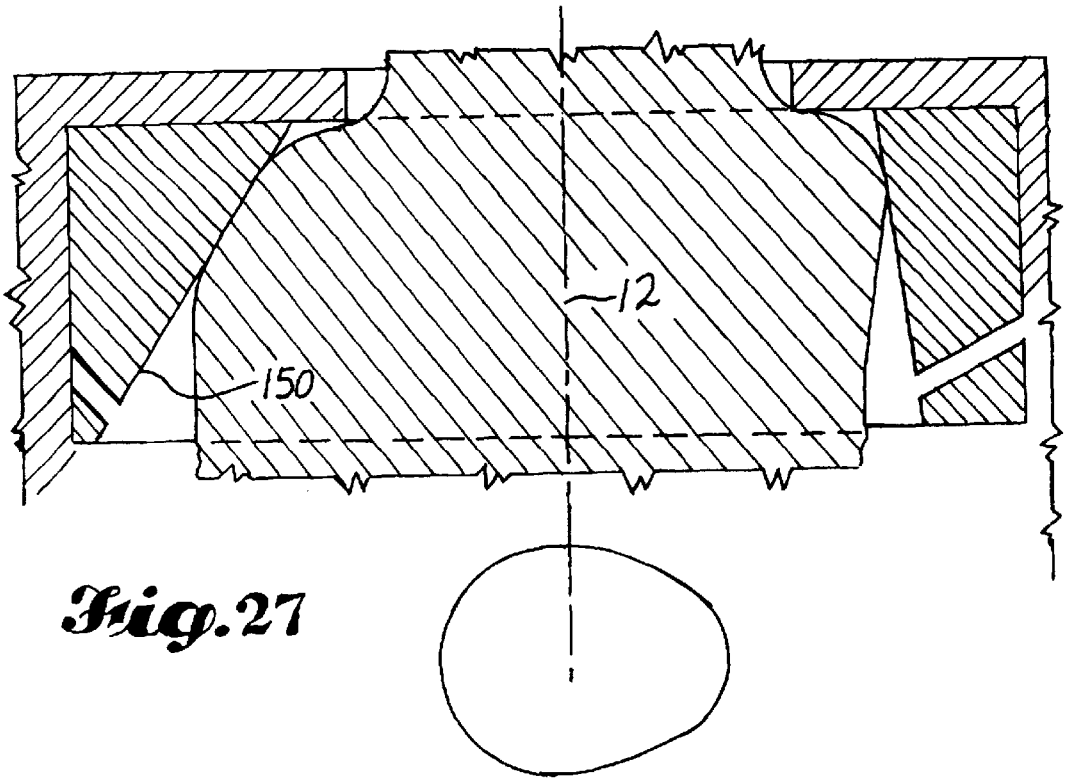
FIG. 27 is a schematic representation of a third way of generating an oval or other symmetric noncircular circumferential outline from a first cross sectional area of circular outline, by varying the inclination of the casting surface on opposing sides of the mold.

There are times, however, when it is advantageous to create a variance between the differentials on mutually opposing sides of the cavity by way of turning a commonplace circumferential outline into some other outline, such as a circular outline into an oval or oblate outline. In FIG. 25, conventional axis orientation control means 144 have been employed to tilt the axis of the cavity at an angle to a vertical line, so that such a variance will convert a circular outline 84 about the first cross sectional area 82 of the cavity, into symmetrical noncircular outlines for the second cross sectional areas 85 thereof, and thus for the circumferential outline of the cross section of the body of metal in the one second cross sectional plane 90 of the cavity in which "solidus" occurs. In FIG. 26, such a variance is created by varying the rate at which heat is extracted from the angularly successive part annular portions 94 of the body of metal on mutually opposing sides thereof. See the variance in the size of the holes 146 and 148. And in FIG. 27, the surface 150 of the graphite ring has been given differing inclinations to the axis of the cavity on mutually opposing sides thereof to create such a variance. In each case, the effect is to produce an oval or oblate circumferential outline for the cross section of the body of metal, as is schematically represented at the bottom of FIGS. 25–27.

Figure 22:
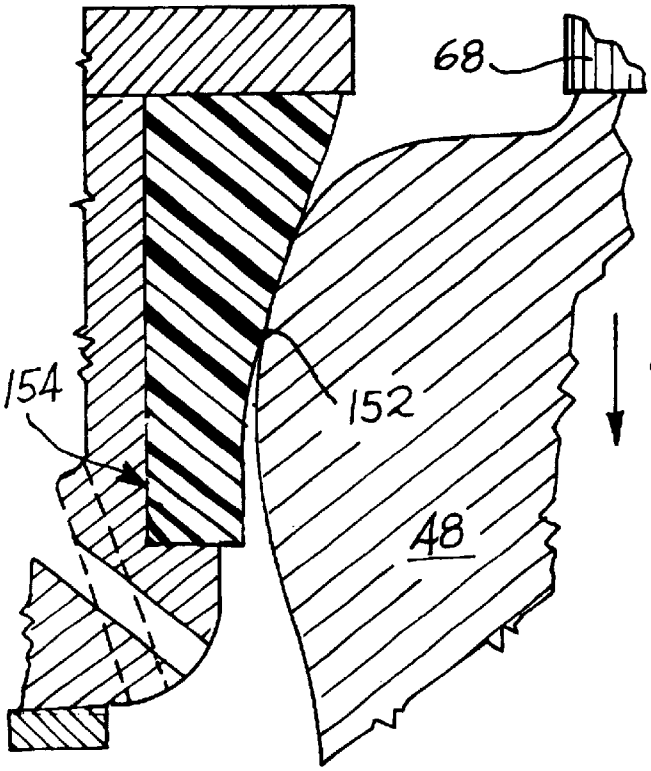
FIG. 22 is an abbreviated axial cross section like that of FIG. 17, but showing a casting ring with a curvilinear casting surface to capture "rebleed;"

I may give the surface of the ring a curvilinear flare or taper, rather than a rectilinear one. In FIG. 22, the surface 152 of the ring 154 is not only curvilinear, but also curved somewhat reentrantly toward a parallel with the axis, below the series of second cross sectional planes 74, and below plane 90 in particular, for purposes of capturing any "rebleed" occurring after "solidus" has occurred. Ideally, in each instance, the casting surface follows every movement of the metal, but just ahead of the same, to lead but also control the progressive peripheral outward development of the metal.

Figure 28:
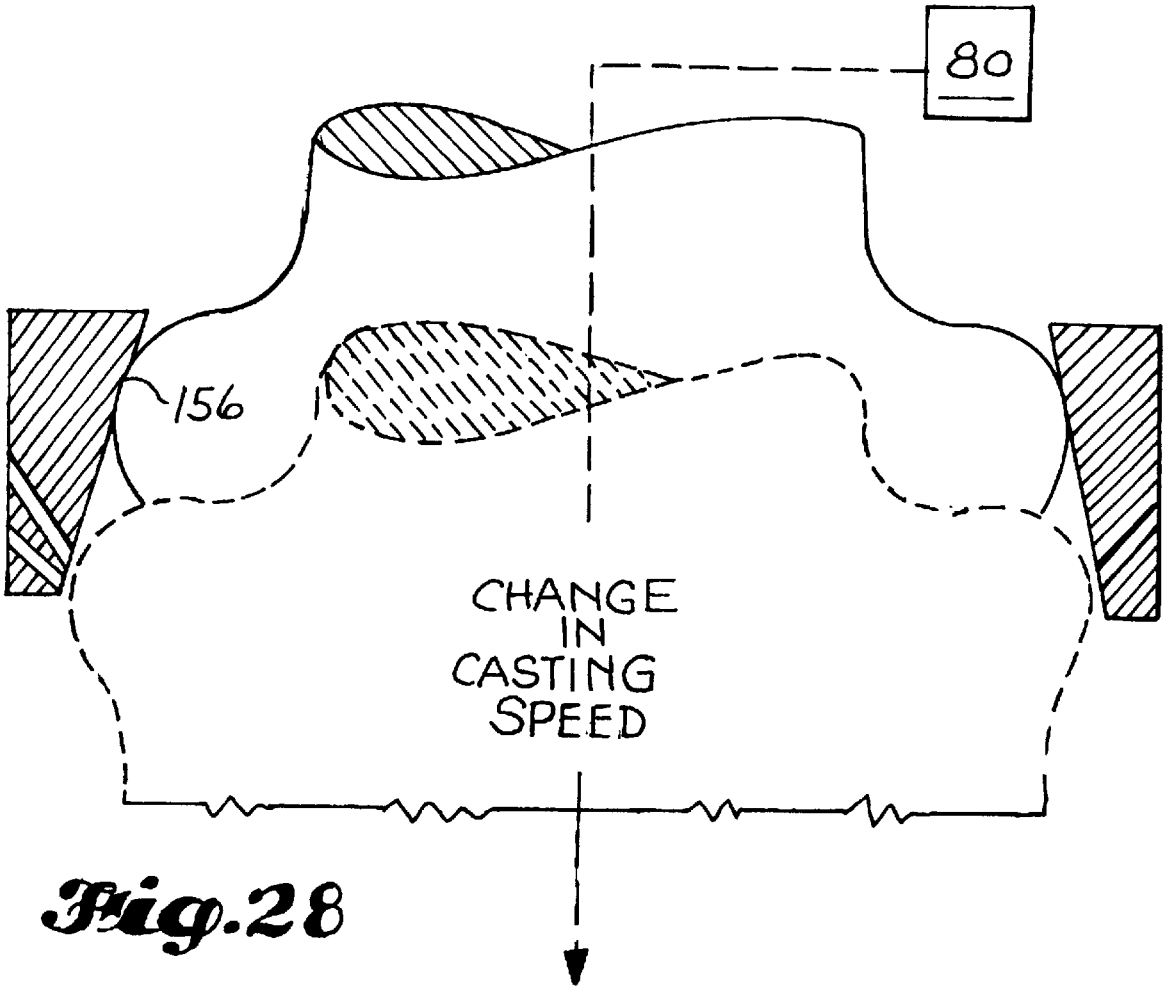
FIG. 28 is a schematic representation of a way of varying the cross sectional dimensions of the cross sectional area of a casting.
Figure 29:
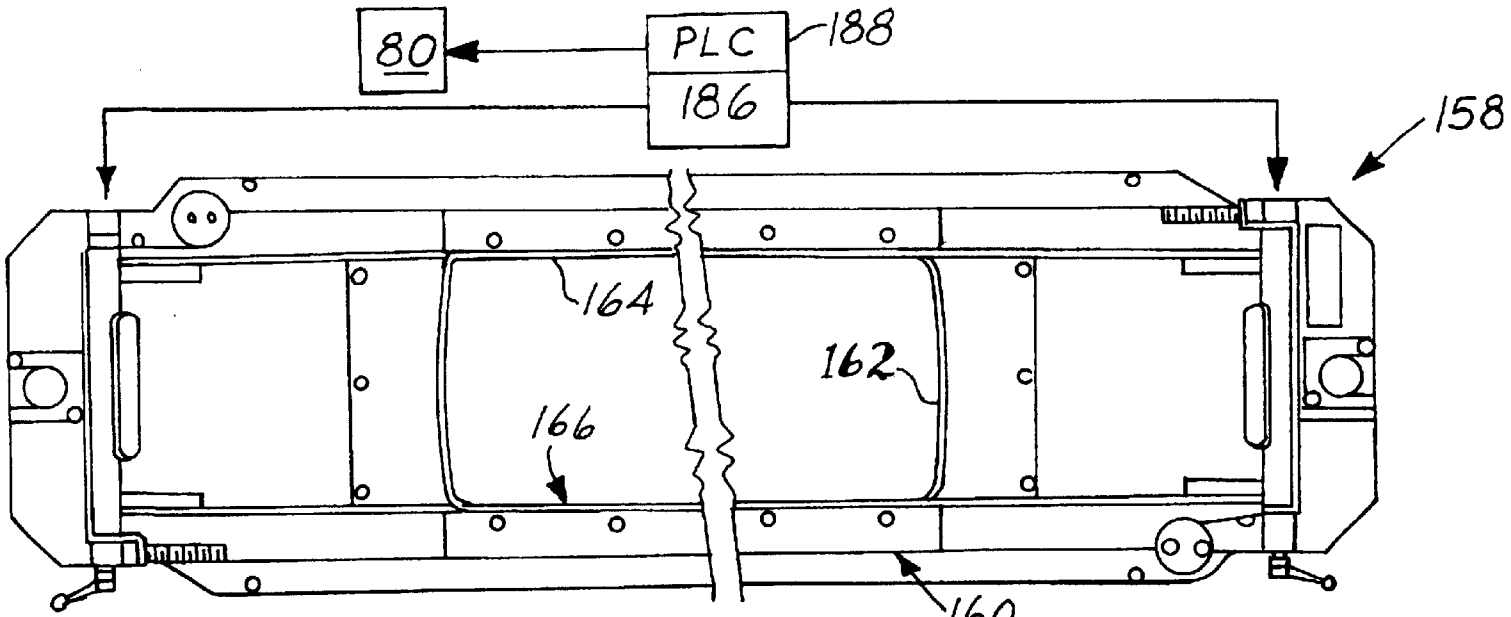
FIG. 29 is a plan view of a four-sided adjustable mold for making rolling ingot, opposing ends of which are reciprocable in relation to one another.
Figure 37:
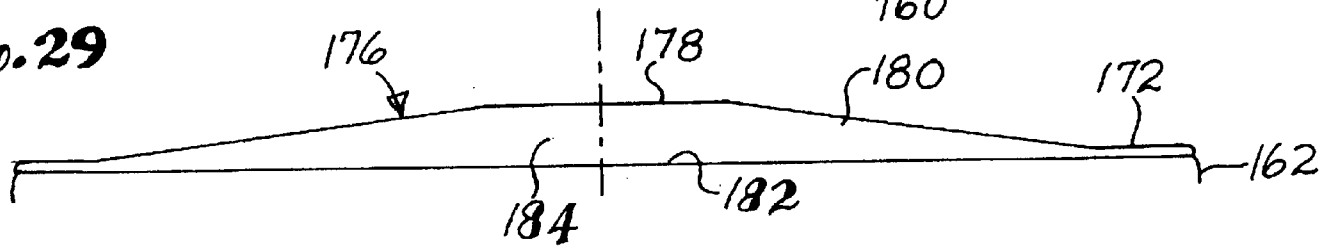
FIG. 37 is a schematic representation of the midsection of the adjustable mold when either of the sides shown in FIGS. 30 and 31 has been used to give the mold a particular length.
Figure 38:
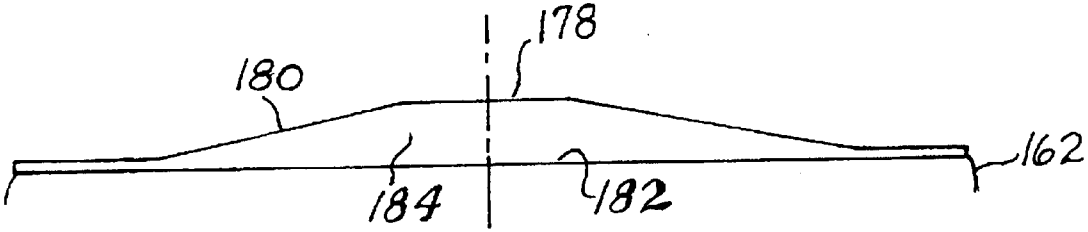
FIG. 38 is a second schematic representation of the midsection when the length of the mold has been reduced.

As indicated earlier, I have also developed means for controlling the cross sectional dimensions conferred on the cross sectional area of the body of metal in the one second cross sectional plane 90 of the cavity in which "solidus" occurs. Referring initially to FIG. 28, it will be seen that I can accomplish this very simply, if I desire, by changing the speed of the casting operation so as to shift the first and second cross sectional planes of the cavity in relation to the surface of the ring, axially thereof. That is, by shifting the first and second cross sectional planes of the cavity to a wider band 156 of the surface, I effectively confer a broader set of dimensions on the cross sectional area of the body of metal; and conversely, by shifting the planes to a narrower band of the surface, I effectively reduce the cross sectional dimensions conferred on the area.

Figure 30:
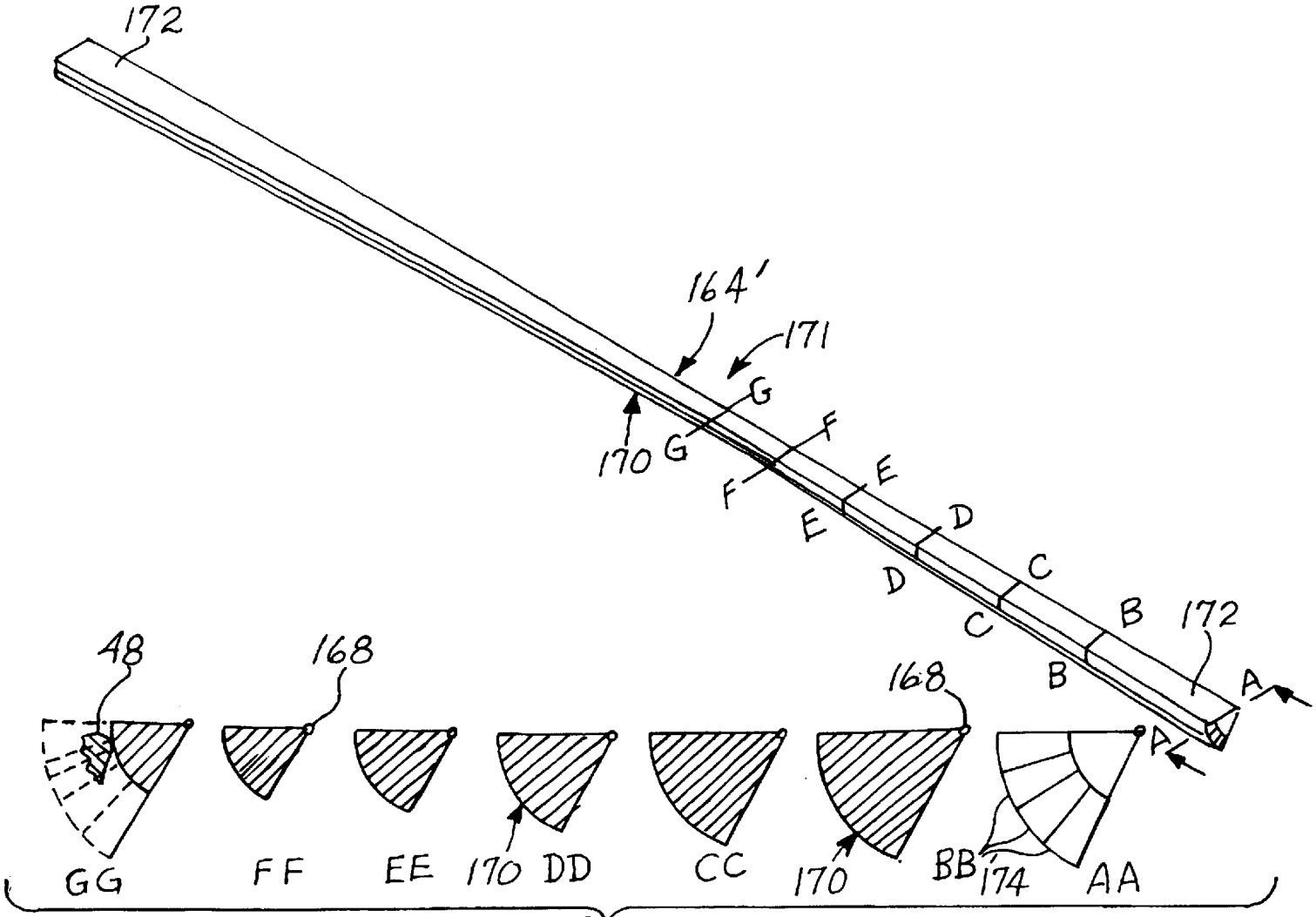
FIG. 30 is a part schematic representation of one of the pair of longitudinal sides of the mold when the longitudinal sides thereof are adapted to rotate in accordance with my invention.

Alternatively, I can shift the band 156 itself, relative to the first and second cross sectional planes of the cavity, to achieve the same effect and in addition, to confer any circumferential outline I choose on opposing sides of the body of metal, such as the flat-sided outline required for rolling ingot. In FIGS. 29–38, I have shown a way of doing this in the context of an adjustable mold for casting rolling ingot. The mold 158 comprises a frame 160 adapted to support two sets of part annular casting members 162 and 164, which together form a rectangular casting ring 166 within the frame. The sets of members are cooperatively mitered at their corners so that one of the sets, 162, can be reciprocated in relation to one another, crosswise the axis of the cavity, to vary the length of the generally rectangular cavity defined by the ring 166. The other set of members, 164, is represented by either the member 164' in FIG. 30, or the member 164" in FIGS. 31–36. Referring first to FIG. 30, it will be seen that the member 164' is elongated, flat topped and rotatably mounted in the frame at 168. The member is also concavely recessed at the inside face 170 thereof, so that it is progressively reduced in cross section, crosswise the rotational axis 168 thereof, in the direction of the center portion 171 of the member from the respective ends 172 thereof. See the respective cross sections of the member, AA through GG. Furthermore, the inside face 170 of the member is mitered at angularly successive intervals thereabout, and the respective mitered surfaces 174 of the face are tapered at progressively smaller radii of the fulcrum 168 in the direction of the bottom of the member from the top thereof. Together then, the mitered effect and the reduced cross sectional effect produce a series of angularly successive lands 174 which extend along the inside face of the member, and curve or angle relatively reentrantly inwardly of the face to give the face a bulbous circumferential outline 176 which is characteristic of that needed for casting flat-sided rolling ingot. The outline is progressively greater in peripheral outward dimension from land to land about the contour of the face, however, so that the face will define corresponding but progressively peripherally outwardly greater cross sectional areas as the member 164' is rotated counterclockwise thereof. See the outline schematically represented at FIG. 37, and note that it has a center flat 178 and tapering intermediate sections 180 to either side thereof, which in turn flow into additional flats at the ends 172 of the member. When the ends 162 of the ring 166 (FIG. 29) are reciprocated in relation to one another to adjust the length of the cross sectional area of the cavity, the side members 164' are rotated in unison with one another until a pair of lands 174 is located on the members at which the compound longitudinal and crosswise taper thereof will preserve the circumferential outline of the cavity, side to side thereof, while at the same time also preserving the cross sectional dimension between the flats 178 of the members, so that the flatness in the sides 182 of the ingot will be preserved in turn.

Figures 31, 32, 33, 34, 35, 36:
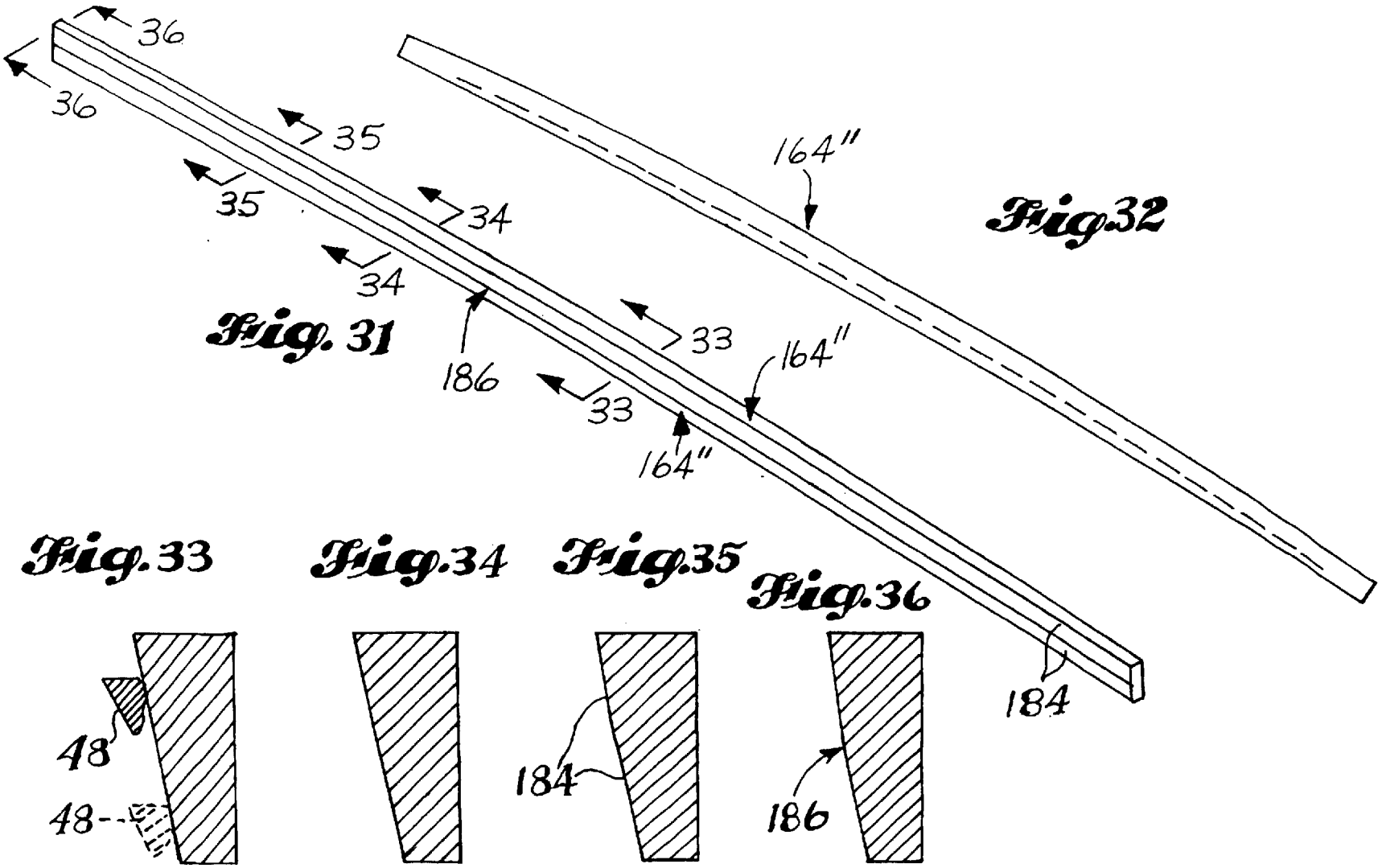
FIG. 31 is a perspective view of one of a pair of longitudinal sides of an adjustable mold when the same are fixed, rather than rotational.
FIG. 32 is a top plan view of the fixed side.
FIG. 33 is a cross section along the lines 33—33 of FIG. 31.
FIG. 34 is a cross section along the lines 34—34 of FIG. 31.
FIG. 35 is a cross section along the lines 35—35 of FIG. 31.
FIG. 36 is a cross section along the lines 36—36 of FIG. 31.

In FIGS. 31–36, the longitudinal sides 164" of the ring are fixed, but they are also convexly bowed longitudinally thereof, as seen in FIG. 32, and variably tapered at angularly successive intervals 184 about the inside faces 186 thereof, and once again, at tapers that also vary from cross section to cross section longitudinally of the members, to provide a compound topography, which like that of the faces 170 on the members 164' in FIG. 30, will preserve the bulbous contour 178 of the midsection 184 of the cavity, when the length of the same is adjusted by reciprocating the ends 162 of the ring in relation to one another. In this instance, however, because the side members 164" are fixed, the first and second cross sectional planes of the cavity are raised and lowered through an adjustment in the speed of the casting operation, so as to achieve a relative adjustment like that schematically shown at 4B in FIG. 33.

The ends 162 of the mold are mechanically or hydraulically driven at 186, but through an electronic controller 188 (PLC) which coordinates either the rotation of the rotors 164', or the level of the metal 48 between the members 164", to preserve the cross sectional dimensions of the cavity at the midsection 184 thereof when the length of the cavity is adjusted by the drive means 186.

Figure 23:
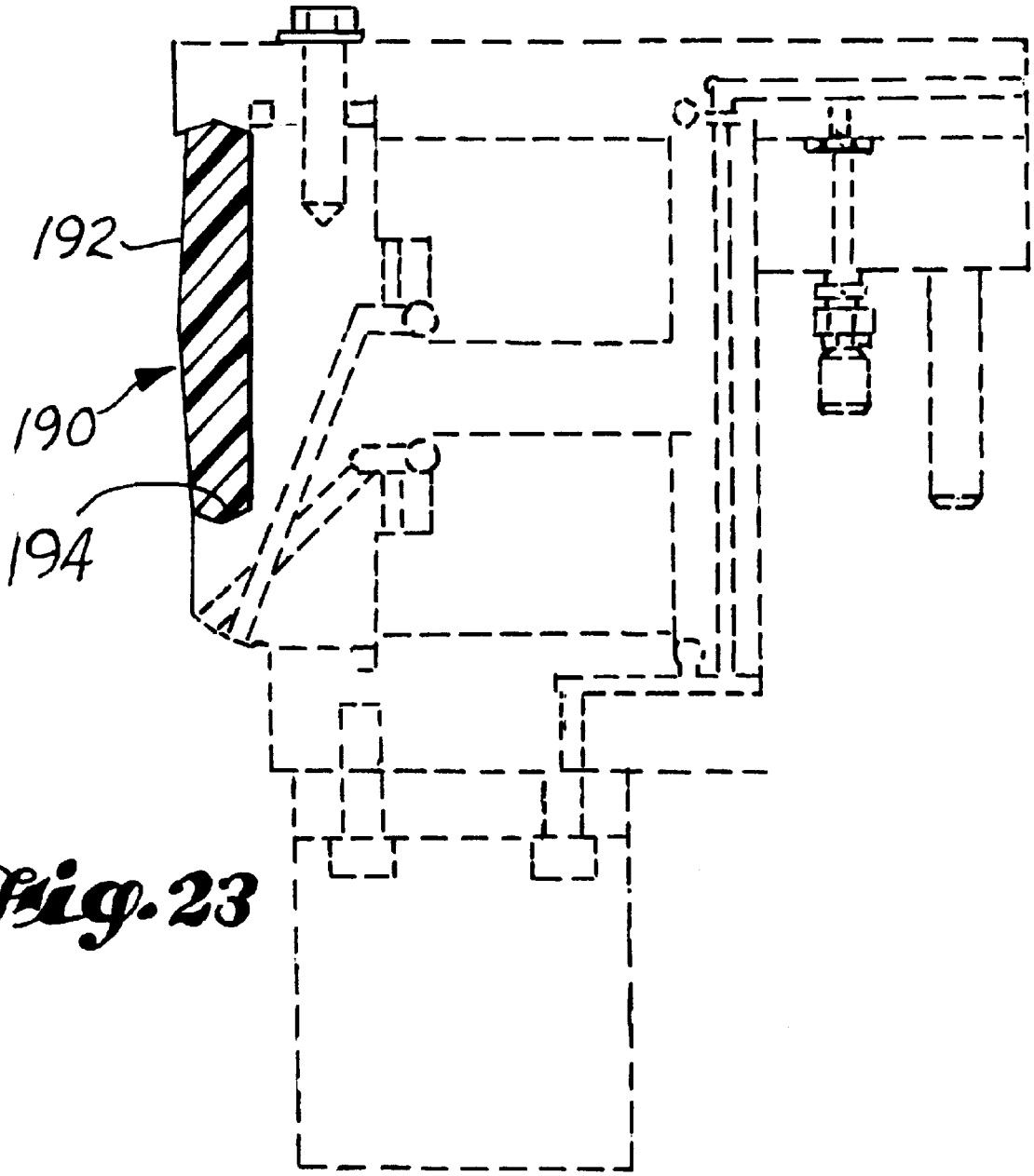
FIG. 23 is a largely phantomized cross section showing a reversible casting ring.

It is also possible to vary the cross sectional outline and/or cross sectional dimensions of the cross sectional area of the body of metal with a casting ring 190 (FIG. 23) which has oppositely disposed tapered sections 192 on the opposing sides thereof axially of the mold. Given differing tapers on the surfaces of the respective sections, the circumferential outline and/or the cross sectional dimensions of the cavity can be changed simply by inverting the ring. However, the ring 190 shown has the same taper on the surface of each section 192, and is employed only as a quick way of replacing one casting surface with another, say, when the first surface becomes worn or needs to be taken out of use for some other reason.

The ring 190 is shown in the context of a mold of the type disclosed in U.S. Pat. No. 5,323,841, and is mounted on a rabbet 194 and clamped thereto so that it can be removed, reversed, and reused as indicated. The other features shown in phantom can be found in U.S. Pat. No. 5,323,841.

My invention also assures that in ingot casting, the molten metal will fill the comers of the mold. As with the other parts of the mold, the corners may be elliptically rounded or otherwise shaped to enable the splaying forces to drive the metal into them most effectively. My invention is not limited, however, to shapes with rounded contours. Given suitable shaping of the second cross sectional areas, angles can be cast in what are otherwise rounded or unrounded bodies.

Figure 39:
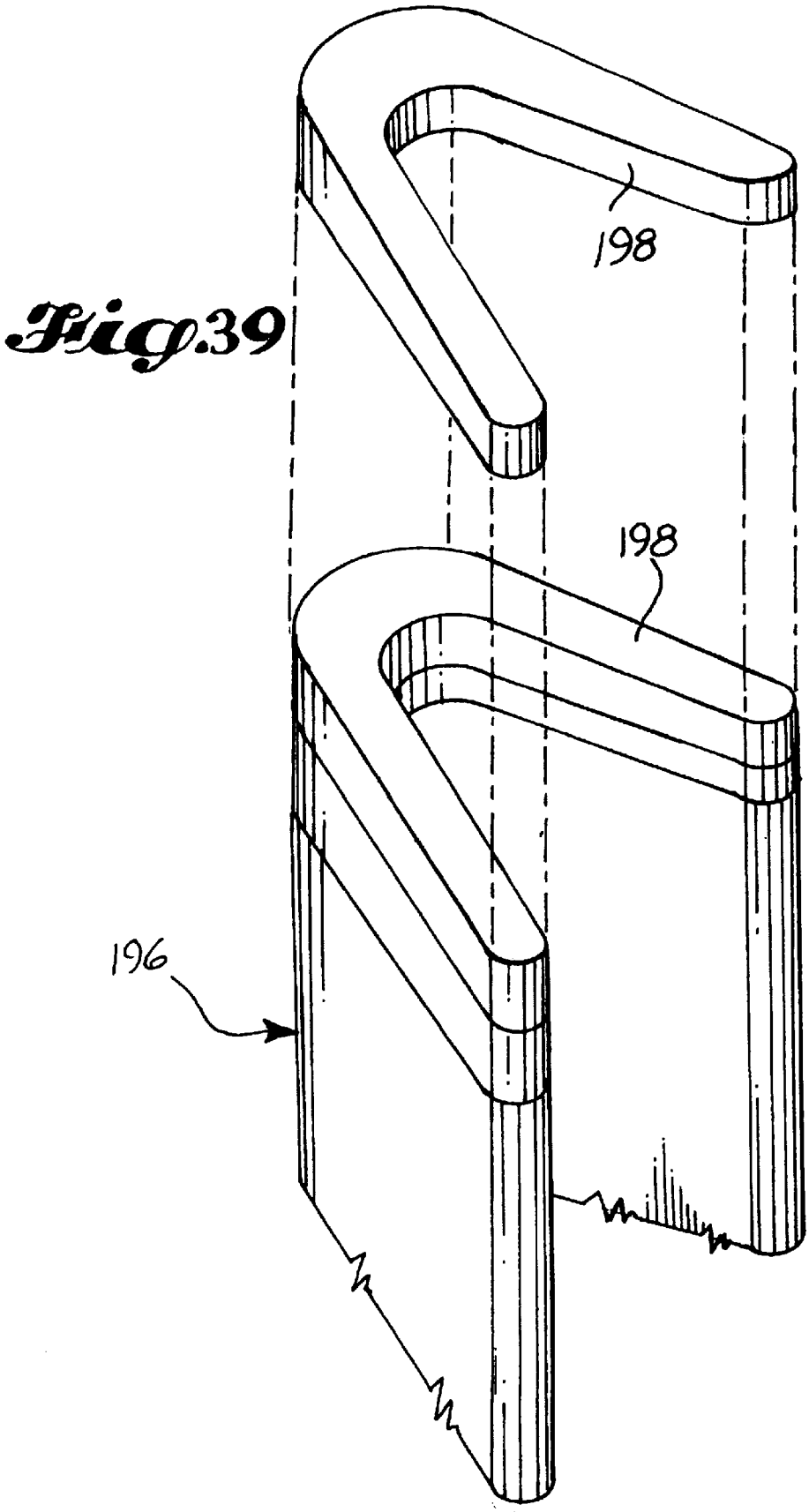
FIG. 39 is an exploded perspective view of an elongated end product that has been subdivided into a multiplicity of longitudinal sections thereof.
Figure 40:
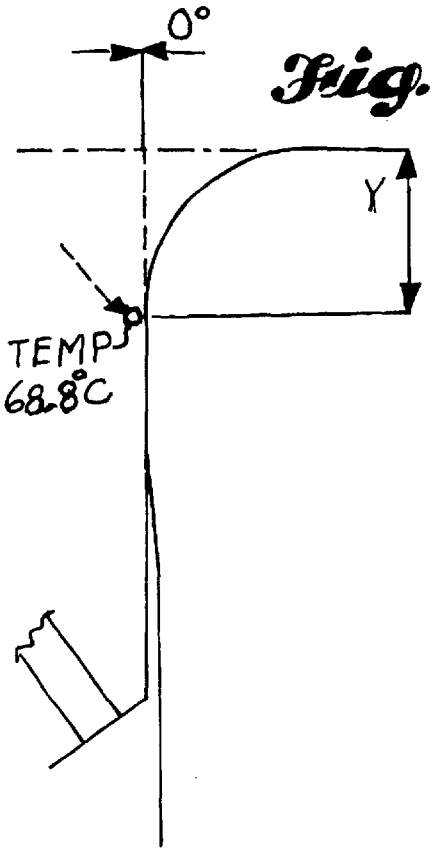
FIG. 40 is a schematic representation of a prior art mold tested for the temperature thereof at the interface between the layers of molten metal and the casting surface.
Figure 41:
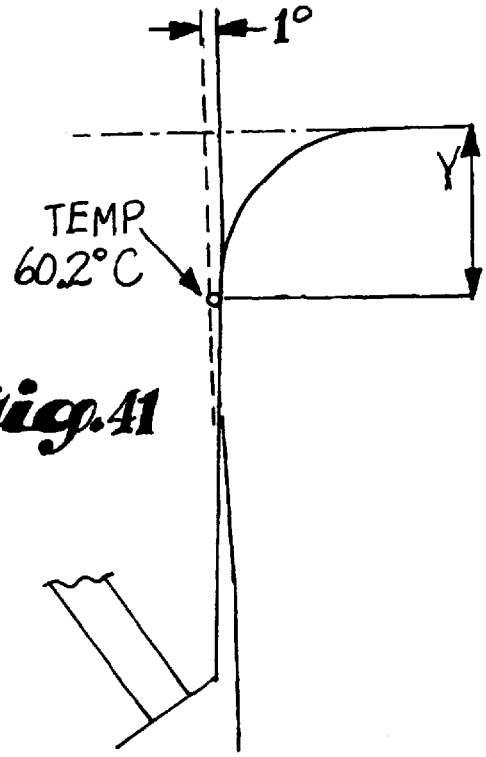
FIG. 41 is a similar representation of one of my casting molds tested for the temperature at its interface when a one degree taper is used in the casting surface.
Figure 42:
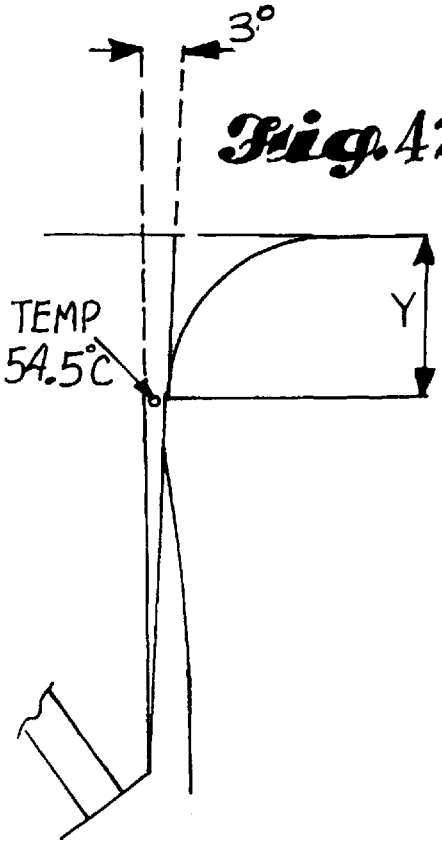
FIG. 42 is a representation similar to Figure when a three degree taper is employed in the casting surface.
Figure 43:
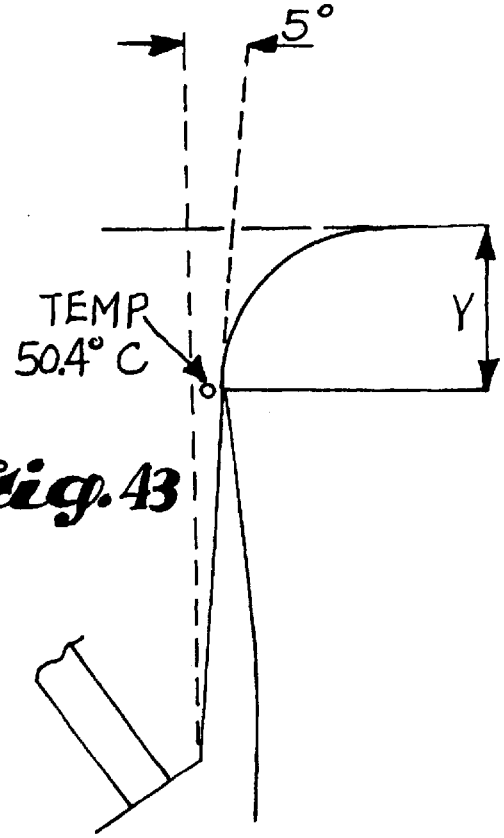
FIG. 43 is another such representation when a five degree taper is employed in the casting surface.

The cast product 196 may be sufficiently elongated to be subdividable into a multiplicity of longitudinal sections 198, as is illustrated in FIG. 39 wherein the V-shaped piece 196 molded in a cavity like that of FIGS. 9–15 and 17, is shown as having been so subdivided. If desired, moreover, each section may be post-treated in some manner, such as given a light forging or other post-treatment in a plastic state to render it more suitable as a finished product, such as a component of an automobile carriage or frame.

Where other than molten start material is used, the body of startup material 70 should be formulated to function as a "moving floor" or "bulkhead" for the accumulating layers of molten metal.

FIGS. 39–42 are included to show the dramatic decrease in the temperature of the interface between the casting surface and the molten metal layers when my means and technique are employed in casting a product. They also show that the decrease is a function of the degree of taper used at any particular point about the interface, circumferentially of the mold. In fact, the best degree of taper from point to point is often determined from taking successive thermocouple readings about the circumference of the mold.

Like the splaying forces, the thermal contraction forces are a function of many factors, including the metal being cast.

What is claimed is:

1. A metal casting unit for use in apparatus wherein molten metal is forced through the unit to cast a body of metal therein, comprising, a molten metal casting mold defining an open ended mold cavity having a peripheral wall circumposed thereabout, an entry end portion, a discharge end opening, and an axis extending between the discharge end opening and the entry end portion of the cavity, the mold having a series of holes therein which are circumposed about the axis of the cavity in the peripheral wall thereof for discharge of liquid coolant onto the body of metal and consequent extraction of heat from respective angularly successive part annular portions of the body of metal arrayed about the axis of the cavity at the circumference of the body of metal, as the body emerges from the cavity at the discharge end opening thereof, and means connected with the series of holes for varying the rate at which heat is extracted from one part annular portion of the body of metal to another part annular portion thereof.

2. The metal casting unit according to claim 1 wherein the mold also has an end wall circumposed about the discharge end opening of the cavity and the series of holes is interposed between the end wall and the discharge end opening of the cavity.

3. The metal casting unit according to claim 1 wherein the series of holes is interposed between the discharge end opening of the cavity and the entry end portion thereof.

4. The metal casting unit according to claim 3 wherein the mold takes the form of a graphite casting ring which has a series of holes therein, bores of the holes are sealed so as to contain the coolant during its passage therethrough.

5. The metal casting unit according to claim 1 wherein the series of holes is divided into rows of holes spaced from each other in a direction of said axis, in which the respective holes thereof are staggered circumferentially in relation to one another from row to row.

6. The metal casting unit according to claim 1 wherein the cavity has a circumferential outline comprising local convex and concave curvatures at the peripheral wall thereof.

7. The metal casting unit according claim 1 wherein the size of the holes operatively opposed to different part annular portions of the body of metal is varied to vary the rate at which heat is extracted from the same.

8. A metal casting ring for use in apparatus wherein molten metal is forced through the ring to cast a body of metal therein, comprising a body of graphite which is annular in shape and has opposing ends thereon and an annular wall extending between the ends thereof defining an open ended mold cavity for the passage of the molten metal therethrough, the body of graphite also having a series of holes therein which are circumposed about the cavity in the annular wall of the body of graphite for discharging liquid coolant onto the body of metal when the ring is put to use in casting the same.

9. The metal casting ring according to claim 8 wherein bores of the holes are sealed so as to contain the coolant during the passage of the coolant therethrough.

10. The metal casting ring according to claim 8 wherein the cavity has a circumferential outline comprising local convex and concave curvatures at the annular wall of the body of graphite.

11. The metal casting ring according to claim 8 wherein said discharge of liquid coolant extracts heat from respective angularly successive part annular portions of the body of metal arrayed about the circumference thereof as the body of metal emerges from the cavity, and means are connected with the series of holes for varying the rate at which heat is extracted from one part annular portion of the body of metal to another part annular portion thereof.

12. The metal casting ring according to claim 11 wherein the holes operatively opposed to different part annular portions of the body of metal are varied in size to vary the rate at which heat is extracted from the same.

13. The metal casting ring according to claim 8 wherein said body of graphite has an axis extending from said opposing ends thereof along which the body of metal is cast, and the series of holes is divided into rows of holes spaced from each other in a direction of said axis, in which the respective holes thereof are staggered circumferentially in relation to one another from row to row.

14. The metal casting ring according to claim 13 wherein the respective rows of holes are inclined to said axis at differing angles of inclination.

15. In a metal casing apparatus, an annular mold defining an open ended mold cavity having an entry end portion, a discharge end opening, an axis extending between the discharge end opening and the entry end portion of the cavity, and a cross sectional area in planes transverse to the axis of the cavity, the circumferential outline of which comprises local convex and concave curvatures and is asymmetrically noncircular in shape, and a generally planar collar for the entry end of the mold, the collar having an axis and an opening therein circumposed about the axis of the collar, and the collar being relatively superimposed on the mold at the entry end portion thereof so that the opening in the collar is coaxial with the axis of the cavity.

16. The metal casting apparatus according to claim 15 wherein the opening in the collar has a cross sectional area in planes transverse to the axis of the collar, the circumferential outline of which corresponds to the asymmetrically noncircular circumferential outline of the cavity and is angularly oriented about the axis of the collar so as to correspond to the angular orientation of the circumferential outline of the cavity about the axis thereof.

17. The metal casting apparatus according to claim 16 wherein the collar is comprised of a refractory material and the inner peripheral edge portion of the collar relatively overlies the mold at the entry end portion thereof so as to form a hot top for the mold.

18. The metal casting apparatus according to claim 15 wherein the mold has an annular rabbet circumposed about the axis of the cavity at the circumferential outline thereof, and a graphite ring seated in the rabbet, the opening of which ring has a cross sectional area in planes transverse to the axis of the cavity, the circumferential outline of which is asymmetrically noncircular in shape angularly oriented about the axis of the cavity so as to correspond to the angular orientation of the circumferential outline of the cavity about the axis thereof, and wherein the inner peripheral edge portion of the of the collar relatively overlies the graphite ring so as to secure the ring in the rabbet and provide a cover for the ring at the entry end of the cavity.

* * * * *